US005678134A

United States Patent [19]

Miki et al.

[11] Patent Number: 5,678,134

[45] Date of Patent: Oct. 14, 1997

[54] CLEANING DEVICE FOR AN IMAGE FORMING APPARATUS

[75] Inventors: Motoharu Miki, Hachioji; Takashi Suzuki, Chofu; Yoshihisa Ichiki, Hachioji, all of Japan

[73] Assignee: Olympus Optical Co., Ltd., Tokyo, Japan

[21] Appl. No.: 624,004

[22] Filed: Mar. 27, 1996

[30] Foreign Application Priority Data

Mar. 31, 1995 [JP] Japan ..... 7-074286
Sep. 26, 1995 [JP] Japan ..... 7-247858

[51] Int. Cl.[6] ..... G03G 15/20

[52] U.S. Cl. ..... 399/71; 15/1.51; 399/327; 399/349

[58] Field of Search ..... 355/271, 283, 355/296, 297, 30, 206, 208, 309, 311; 347/155, 156; 15/1.51; 399/327, 349; 219/216

[56] References Cited

U.S. PATENT DOCUMENTS

| | | | |
|---|---|---|---|
| 2,832,977 | 5/1958 | Walkup et al. | 15/1.51 |
| 3,716,018 | 2/1973 | Ohta et al. | 355/283 X |
| 3,884,572 | 5/1975 | Bacon et al. | 355/297 |
| 4,479,709 | 10/1984 | Syukuri et al. | 355/296 |
| 4,588,279 | 5/1986 | Fukuchi et al. | 355/271 |
| 5,253,022 | 10/1993 | Takeuchi et al. | 355/271 X |
| 5,260,754 | 11/1993 | Yano et al. | 355/296 |
| 5,442,422 | 8/1995 | Owens, Jr. et al. | 355/296 X |
| 5,452,058 | 9/1995 | Umeda | 355/311 X |

FOREIGN PATENT DOCUMENTS

| | | |
|---|---|---|
| 59-133581 | 7/1984 | Japan . |
| 61-55677 A | 3/1986 | Japan . |
| 62-286082 | 12/1987 | Japan . |
| 63-98687 | 4/1988 | Japan . |
| 63-289574 | 11/1988 | Japan . |
| 1-232377 A | 9/1989 | Japan . |
| 2-244185 | 9/1990 | Japan . |
| 2-309378 A | 12/1990 | Japan . |
| 4-45829 BZ | 7/1992 | Japan . |
| 5-173465 | 7/1993 | Japan . |
| 5-303305 | 11/1993 | Japan . |
| 6-27833 | 2/1994 | Japan . |

*Primary Examiner*—Arthur T. Grimley
*Assistant Examiner*—Sophia S. Chen
*Attorney, Agent, or Firm*—Frishauf, Holtz, Goodman, Langer & Chick

[57] ABSTRACT

An endless belt is passed between a visible image forming unit and a thermal transfer unit. A cleaning device for removing residual toner on the endless belt is provided on the downstream side of the thermal transfer unit. The cleaning device comprises a cleaning roller having a rigid surface member of a metal coated with an elastic member, a contacting/separating mechanism for contacting/separating the cleaning roller with/from the endless belt, and a refresh blade for removing the toner staying on the cleaning roller. Separated from the endless belt, the cleaning roller is contacted with the refresh blade.

85 Claims, 23 Drawing Sheets

CLEANING DEVICE FOR AN IMAGE FORMING APPARATUS

BACKGROUND OF THE INVENTION

1. Field of the Invention

The present invention relates generally to a cleaning device for an image forming apparatus, and more particularly to a cleaning device for removing toner left on the surface of an endless member, such as a transfer belt, a dielectric belt or a heat roller, which is put in contact with a recording medium at the time of fixation.

2. Description of the Related Art

<First Prior Art>

Jpn. Pat. Appln. KOKOKU Publication No. 4-45829 discloses an image forming apparatus wherein a toner image is formed on an image carrying body and the formed toner image is transferred onto a recording paper sheet. As seen from FIG. 27A, in this image forming apparatus, a toner image is formed on a photosensitive drum 201, and the formed toner image is transferred onto an intermediate transfer roller 205. A recording sheet 213 is pressed on the intermediate transfer roller 205 by means of a fixing pressing roller 207. Thus, the toner image is transferred onto the recording sheet 213.

The image forming apparatus includes a cleaning roller 206 for cleaning toner left on the intermediate transfer roller 205 after the transfer. The cleaning roller 206, as shown in FIG. 27B, comprises a roller core **206*a* formed of a metal such as aluminum, a heat-resistant rubber layer 206*b* surrounding the roller core 206*a*, and a nickel thin layer 206*c* which can be easily heated and is provided around the rubber layer 206*b*. In a cleaning position, the nickel thin layer 206*c* of the cleaning roller 206 can be put in close contact with an outermost silicone-rubber layer 205*a* of the intermediate transfer roller 205. Since the specific heat of the nickel thin layer 206*c* is low, the temperature of the nickel thin layer 206*c* can be easily raised up to the temperature of the intermediate transfer roller 205. Thus, the nickel thin layer 206*c* absorbs a little amount of heat from the intermediate transfer roller 205. Toner, which has not been transferred onto the recording sheet 213 and has been left on the intermediate transfer roller 205, is heated up to the temperature of the intermediate transfer roller 205 put in close contact with the surface of the cleaning roller 206. The molten toner is adhered to the nickel thin layer 206*c* of the cleaning roller 206 with high adhesive force. Thus, the intermediate transfer roller 205** is cleaned.

In the above image forming apparatus, if the cleaning roller 206 is stained with adhered toner, the cleaning performance thereof deteriorates. Thus, the cleaning roller 206 stained to some degree is replaced with a new one. The replacement of the cleaning roller 206 results in an increase in running cost and, accordingly, a great maintenance cost on the side of the user. Furthermore, the reliability of the image forming apparatus is considerably degraded and, as a result, high reliability and maintenance-free construction demanded for computer network systems, etc. are hindered.

Since the surface of the cleaning roller 206 is covered with the hard nickel thin film **206*c*, the nickel thin film 206*c* wears the silicone rubber 205*a* on the surface of the intermediate transfer roller 205 and greatly shortens the life of the roller 205**.

Besides, if the operation of the image forming apparatus is suddenly halted due to the occurrence of abnormality such as jam, much toner fails to be transferred onto the recording sheet and remains on the surface of the intermediate transfer roller 205. Thus, the cleaning performance of the cleaning roller 206 deteriorates.

In this apparatus, the temperature of the nickel thin layer **206*c* of the cleaning roller 206 is made equal to that of the intermediate transfer roller 205 and the cleaning roller 206 cleans the intermediate transfer roller 205 by making use of a difference in adhesive force of molten toner on the nickel thin layer 206*c* and intermediate transfer roller 205**. Although it is described as an object in this prior-art document to make the temperature of toner constant for the purpose of cleaning, no mention is made of the control of the temperature of toner to be cleaned.

<Second Prior Art>

Jpn. Pat. Appln. KOKAI No. 61-55677 discloses a fixing apparatus, as shown in FIG. 28. A fixing apparatus 416 comprises a first roller **416*a* and a second roller 416*b*. A paper sheet 420 on which a toner image 420*a* is formed is clamped under pressure between the two rollers 416*a* and 416*b*, and thus the toner image 420*a*** is fixed.

A first cleaning roller 417, which is put in contact with the first roller **416*a* and on which felt is wound, rotates in accordance with rotation of the first roller 416*a* and cleans the first roller 416*a*. Similarly, a second cleaning roller 418, which is put in contact with the second roller 416*b* and on which felt is wound, rotates in accordance with the second roller 416*b* and cleans the second roller 416*b***.

Since the first cleaning roller 417 and second cleaning roller 418 are put in pressure contact with the first roller **416*a* and second roller 416*b*, respectively, the friction between the rollers shortens the lives of the first roller 416*a* and second roller 416*b*. Like the first prior art, the cleaning rollers 417 and 418**, if stained, need to be replaced with new ones, resulting in a high maintenance cost on the side of the user.

<Third Prior Art>

Jpn. Pat. Appln. KOKAI Publication No. 2-309378 discloses an apparatus for thermally cleaning a belt of a belt fixing device, as shown in FIG. 29A.

A fixing film 305 is passed over a driving roller 301 and a driven roller 302 through the region between a heater 304 and a pressing roller 303. The fixing film 305 is driven by the driving roller 301. Offset toner 312 adheres to the fixing film 305 which has fixed toner on a recording paper sheet 318. The offset toner 312 is melted by the driven roller 302 heated by a halogen lamp 306 and adhered to a cleaning roller 307. Thus, the fixing film 305 is cleaned.

FIG. 29B shows a structure wherein a halogen lamp 306A is provided inside the cleaning roller 307, in contrast to the apparatus shown in FIG. 29A wherein the halogen lamp 306 is provided inside the driven roller 302. The offset toner 312 adhered to the fixing film 305 is melted by the cleaning roller 307 heated by the halogen lamp 306A. The molten toner adheres to the cleaning roller 307 and thus the fixing film 305 is cleaned.

In each apparatus, the cleaning roller 307 is not heated by the heat of the fixing film 305. Instead, the cleaning roller 307 is heated by the halogen lamp 306 or 306A, thereby cleaning the fixing film 305. Although the heating source is provided, this third prior art, like the first prior art, is silent on the control of the temperature of toner to be cleaned.

<Fourth Prior Art>

Jpn. Pat. Appln. KOKAI Publication No. 1-232377 discloses a cleaning device for an image forming apparatus wherein a toner image formed on a recording member is transferred onto a transfer medium. The structure of this apparatus is shown in FIG. 30.

As is shown in FIG. 30, a cleaning brush 402 for removing toner left on a photosensitive drum 401 is rotatably supported at one end portion of an arm 404. The arm 404 is moved in a swinging manner by a motor 405. Thereby, the cleaning brush 402 is put in contact with and separated from the photosensitive drum 401. A duct 403 sucks and exhausts toner removed from the surface of the photosensitive drum 401 by the cleaning brush 402. The motor 405 is driven by a driver 406. The driver 406 is controlled by a printer controller 408. The printer controller 408 is controlled by a host 407 and controls a printing mechanism unit 409 such as a printer.

When image formation is not performed, the cleaning brush 402 is retreated from the surface of the photosensitive drum 401, thereby preventing a filming phenomenon (i.e. a phenomenon in which toner adheres to the surface of a photosensitive drum) from occurring due to long-time contact between the cleaning brush 402 and the surface of the photosensitive drum 401.

The cleaning effect increases or decreases, depending on the surface temperatures of the photosensitive drum 401 and cleaning brush 402. The fourth prior art is silent on the idea that a high cleaning effect is maintained by controlling the contact/separation of the cleaning brush 402.

SUMMARY OF THE INVENTION

An object of the present invention is to provide a cleaning technique for realizing a cost-effective image forming apparatus for forming a high-quality image on a recording paper sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will now be described with reference to the accompanying drawings.

<First Embodiment>

Figure 1:
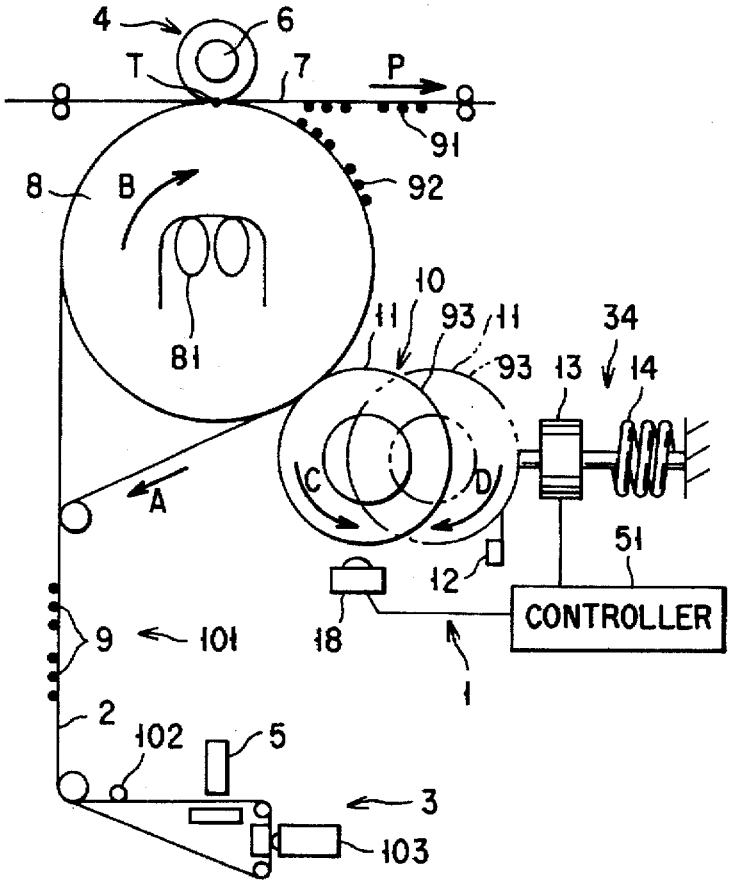
FIG. 1 shows an image forming apparatus having a cleaning device according to a first embodiment of the present invention.

A cleaning device according to a first embodiment of the invention will now be described with reference to FIG. 1. FIG. 1 shows an image forming apparatus having the cleaning device of the first embodiment.

An endless belt 2 is passed, and runs, between a visible image forming unit 3 provided in the lower part of the apparatus and a thermal transfer unit 4 provided in the upper part of the apparatus. An electrostatic latent image is formed on the endless belt 2 by an electrostatic image forming device 5, which is, for example, an ion stream control type recording device or a device for forming a latent image by a laser beam, etc., after uniformly charging the endless belt 2. Then, toner is adhered to the electrostatic latent image by a developing device 103. Thus, a toner image 9 is formed and the electrostatic latent image is made visible. The endless belt 2 with the toner image 9 runs between a heat roller 8 and a pressing roller 6 along with a recording paper sheet 7 conveyed in a direction P. The heat roller 8 is heated by a heat roller heater 81 provided within the heat roller 8 itself. The endless belt 2 with the toner image 9 is heated on the reverse side thereof by the heat roller 8, and the toner image 9 on the endless belt 2 is softened. At a thermal transfer position T, the toner image 9 is thermally transferred onto the recording sheet 7 and at the same time the toner image 9 is pressed by the pressing roller 6 and fixed on the recording sheet 7. Then, the recording sheet 7 and the endless belt 2 are separated by a separating device (not shown), and the recording sheet 7 is discharged to a discharge tray (not shown), etc.

The obverse face of the endless belt 2 is generally coated with a material such as fluoroplastics or silicone with high separation properties to toner and high heat resistance. The transfer ratio of toner onto the recording sheet, however, is not 100%. A small amount of residual molten toner 92 is left on the obverse face of the endless belt 2. The residual toner 92 is removed by a cleaning device 1. The endless belt 2 without residual toner 92 is passed through a heat exchanger 101 and restored to an electrically neutral state by an eraser 102. Thus, the endless belt 2 can be used for the formation of the next image.

The cleaning device 1 has a cleaning roller 10. The surface of the cleaning roller 10 is coated with an elastic member 11, thereby preventing wear of the endless belt 2 and cleaning roller 10. The elastic member 11 is formed of a heat-resistant resin or rubber which does not damage the endless belt 2 and has a greater surface energy than the surface of the endless belt 2. Examples of the resin are phenol resin, melamine resin, aryl resin, furan resin, unsaturated polyester resin, alkyd resin, epoxy resin, silicone resin, polyimide, polyamideimide, polyethersulfone, polysulfone, polyarylether, polyarylsulfone, polybutadiene, fluoroplastics, thermoplastic polyester, and polyphenylene sulfide. Examples of the rubber are chloroprene acryl rubber, nitrile butadiene rubber, isobutylen isoprene rubber, ethylene propylene rubber, silicone rubber, chlorosulfonated polyethylene rubber, chlorinated polyethylene rubber, acryl rubber, and epichlorohydrin rubber.

The cleaning roller 10 is put in contact with the endless belt 2 and is rotated in a direction C in accordance with the rotation of the belt 2 in a direction A of movement of the endless belt 2. The softened residual toner 92 adheres to the surface of the cleaning roller 10 by the adhesive force acting between the residual toner 92 and the surface of the cleaning roller 10. As a result, the surface of the endless belt 2 is cleaned. According to the experiments made by the inventors, good results were obtained when the elastic member was formed of polyimide, MYLAR™, (polyester film) polyolefin resin, or silicone rubber.

The cleaning device 1 is provided with a contacting/separating mechanism for contacting/separating the cleaning roller 10 with/from the endless belt 2. The contacting/separating mechanism 34 comprises an electromagnetic clutch 13 and a spring 14. The cleaning device 1 includes a stain sensor 18 for sensing the stain of the cleaning roller 10 and a controller 51 for controlling the supply of power to the electromagnetic clutch 13. When the electromagnetic clutch 13 is activated, the cleaning roller 10 is brought into contact with the endless belt 2, as indicated by a solid line. When the supply of power to the electromagnetic clutch 13 is stopped, the cleaning roller 10 is separated from the endless belt 2 by the force of the spring 14, as indicated by a two-dot-and-dash line.

Normally, power is supplied to the electromagnetic clutch 13 and the cleaning roller 10 is put in contact with the endless belt 2. If residual toner 92 adheres and accumulates on the surface of the cleaning roller 10 and the surface of the cleaning roller 10 is covered with adhered toner 93, the sensor 18 facing the cleaning roller 10 senses the stain of the roller 10 and the controller stops power to the electromagnetic clutch 13. Thus, the cleaning roller 10 is separated from the endless belt 2 and the cleaning roller 10 is cooled.

The stain sensor 18 is, for example, a device for radiating light on the cleaning roller 10 and sensing reflected light. As the surface of the cleaning roller 10 is covered with the adhered toner 93, the amount of reflection light from the cleaning roller 10 decreases and the condition of stain is detected. Alternatively, the stain sensor 18 is a device for sensing a distance between itself and the cleaning roller 10. As the surface of the cleaning roller 10 is covered with the adhered toner 93, the distance between the device and the cleaning roller 10 decreases and the condition of the stain is detected.

The cleaning device 1 further includes a refresh blade 12 as refresh member for removing the adhered toner 93 from the surface of the cleaning roller 10. Since the adhered toner 93 is basically formed of a thermoplastic resin, the viscosity of the toner 93 decreases as it is cooled, and the cooled toner 93 is easily broken by mechanical shock. Thus, the refresh blade 12 is put in mechanical contact with the adhered toner 93 on the cleaning roller 10, thereby easily and completely removing the toner 93 from the cleaning roller 10. After the refreshing operation, the cleaning roller 10 exhibits the same cleaning performance as a new one. Since the cleaning roller 10, which has conventionally been a consumable part, is easily and completely refreshed and permanently used. Thus, the running cost is reduced and the maintenance cost on the side of the user is reduced.

Since the cleaning roller 10 can be contacted/separated with/from the endless belt 2, the cleaning roller 10 can be cooled in a short time, independent of the temperature of the endless belt 2. Thus, the refresh time is shortened and accordingly the halt time of the image forming apparatus in which the cleaning device 1 is built is shortened. In addition, since the cleaning roller 10 is separated from the endless belt 2 at the time of refreshing, the endless belt 2 need not be driven and the wear of the belt 2 is prevented. Furthermore, dispersed toner produced at the refresh time does not readhere to the endless belt 2, and the image quality of the image forming apparatus is stabilized.

While the main switch of the image forming apparatus is turned off, the cleaning roller 10 is separated from the endless belt 2. When the main switch is turned on, the refresh operation is performed during a start-up time of the image forming apparatus, following which the cleaning roller 10 is put in contact with the endless belt 2. Since this operational sequence is preset, there is no halt time period on the user side, and the cleaning roller 10 can be refreshed in a predetermined time. Besides, since the cleaning roller 10 is separated from the endless belt 2 at the time of turn-off of the apparatus, wear of the endless belt 2 is prevented.

Furthermore, if power to the image forming apparatus is stopped in any case, the cleaning roller 10 is automatically separated from the endless belt 2. Thus, it is possible to prevent wear, deformation or denaturing of the endless belt 2 due to the contact between the cleaning roller 10 and endless belt 2.

As has been described above, in the present embodiment, the cleaning roller 10 which has conventionally been a consumable part can be easily and completely refreshed and permanently used. Thus, the running cost is reduced and the maintenance cost on the side of the user is reduced. Moreover, since the cleaning roller 10 need not be replaced as a consumable part, high reliability and maintenance-free construction demanded for computer network systems, etc. can be achieved.

<Second Embodiment>

Figure 2:
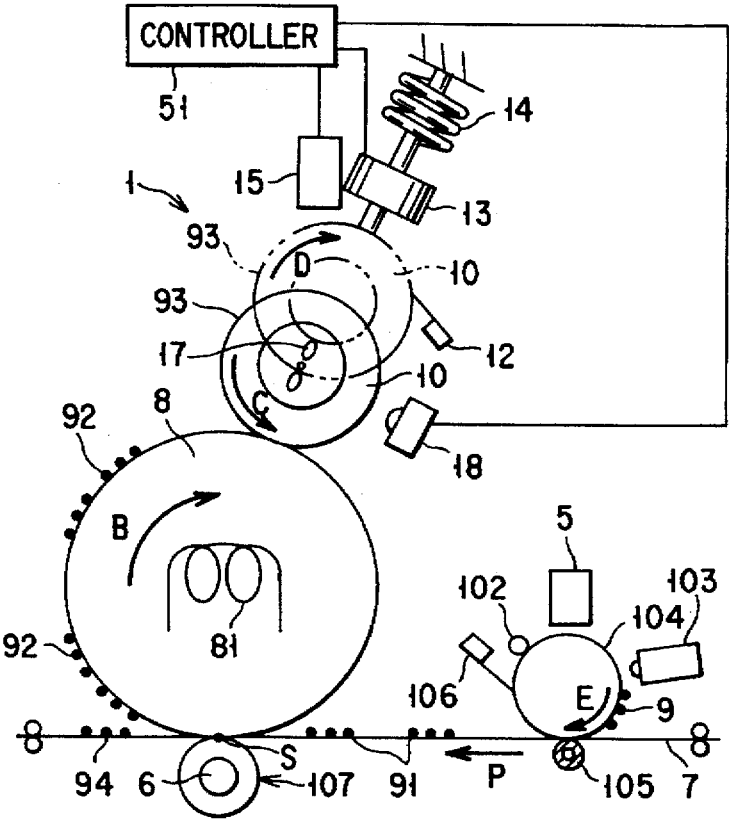
FIG. 2 shows an image forming apparatus having a cleaning device according to a second embodiment of the present invention.

A cleaning device according to a second embodiment of the invention will now be described with reference to FIG. 2. FIG. 2 shows an image forming apparatus having the cleaning device of this embodiment.

An image forming process is performed in the following manner. An electrostatic latent image is formed on a drum 104 by means of an electrostatic image forming device 5, which is, for example, an ion stream control type recording device or a device for forming a latent image by a laser beam, etc. after uniformly charging the drum 104. Then, toner is adhered to the electrostatic latent image by a developing device 103. Thus, a toner image 9 is formed and the electrostatic latent image is made visible. The toner image 9 on the drum 104 is transferred onto a recording paper sheet 7 (which is conveyed in a direction P).by a transfer member 105. The transfer member 105 is, for example, an electrostatic transfer member or a thermal transfer member. After the transfer of the toner image 9, the drum 104 is cleaned by a cleaner 106 and restored to an electrically neutral state by an eraser 102 for the formation of the next image. The recording sheet 7 bearing the transfer toner image 91 in an unfixed state is transferred to a point S between a heat roller 8 and a pressing roller 6 and heated by the heat roller 8. Thus, the transfer toner image 91 is softened and thermally fixed on the recording sheet 7. Then, the recording sheet 7 is separated by a separating device (not shown).

When a fixed toner image 94 is separated from the heat roller 8, a little amount of offset toner remains on the surface of the heat roller 8 as residual toner 92. If the residual toner 92 is fixed on the next recording paper sheet, the image quality is degraded. To prevent this problem, a cleaning device 1 for removing the residual toner 92 is provided.

The cleaning device 1 has a cleaning roller 10 driven by the heat roller 8 in a direction C. The residual toner 92 is adhered to the surface of the cleaning roller 10, thereby cleaning the heat roller 8. The cleaning device 1 is electrically connected to a controller 51. When the number of printed sheets has reached a predetermined value or the amount of used toner has reached a predetermined value, the controller 51 stops the supply of power to an electromagnetic clutch 13. Consequently, the cleaning roller 10 is separated from the heat roller 8 and the refresh operation for the cleaning roller 10 is started.

The cleaning device 1 may be provided with a stain sensor 18 for monitoring the amount of adhered toner 93 on the surface of the cleaning roller 10. The stain sensor 18 is, for example, a device for radiating light on the cleaning roller 10 and sensing reflected light, or a device for sensing a distance between itself and the cleaning roller 10, thereby sensing the amount of the adhered toner 93. The stain sensor 18 delivers to the controller 51 a stain signal indicating that the cleaning 10 has been stained, before the cleaning performance of the cleaning roller 10 is degraded. In response to the stain signal, the controller 51 stops the supply of power to the electromagnetic clutch 13. Consequently, the cleaning roller 10 is separated from the heat roller 8 by the mechanical force of the spring 14 and cooled, and then the refresh operation for the cleaning roller 10 is started. Since the stain of the cleaning roller 10 is sensed by the stain sensor 18 and the refresh operation for the cleaning roller 10 is performed, the cleaning roller 10 can always have an adequate cleaning performance, and the image quality is stabilized.

The cleaning device 1 includes a cooling fan 17 for cooling the cleaning roller 10 separated from the heat roller 8. The cooling fan 17 starts to rotate the moment the cleaning roller 10 has been separated from the heat roller 8, and cools the cleaning roller 10 quickly. Thereby, the time for the refresh operation is shortened.

The cleaning unit 1 also includes a vibration device 15 for beating the toner layer 93 of cooled and solidified toner on the cleaning roller 10. The vibration device 15 beats the cooled and solidified toner layer 93 adhering to the surface of the cleaning roller 10, thereby cracking or toughening the toner layer 93. The cracked or roughened toner layer 93 is easily raked off by a refresh blade 12. Since the solidified toner layer 93 adhering to the cleaning roller 10 has a smooth surface, the refresh blade 12 may slip on the smooth surface. However, if the smooth surface is beaten by the vibration device 15 to have cracks or roughness, the refresh blade 12 is easily caught on the surface. Thus, the refresh time for the cleaning roller 10 is shortened and the adhered toner is completely removed.

The cleaning roller 10 completely refreshed in this manner is put in contact with the heat roller 8 once again by the electromagnetic clutch 13. Without replacing the cleaning roller 10, etc., the cleaning of the heat roller 8 can be restarted.

In a regular fixing device, residual toner is cleaned by putting a felt pad, a web, etc. into contact with the toner. As the residual toner adheres to the pad, web, etc., however, the cleaning performance deteriorates and the image quality becomes unstable. In order to stabilize the image quality, cleaning members are frequently replaced, resulting in an increase in the running cost and a high maintenance cost on the side of the user. Besides, the reliability of the image forming apparatus is considerably degraded. Consequently, high reliability and maintenance-free construction demanded for computer network systems, etc. cannot be achieved.

In the present embodiment, the heat roller 8 of the fixing device 107 is cleaned by the cleaning roller 10 driven by the heat roller 8, and the adhered toner 93 on the cleaning roller 10 is easily and completely removed. Thus, the cleaning roller 10 can be used permanently. Accordingly, the running cost is decreased and the maintenance cost on the side of the user is reduced. Unlike as the prior art, there is no need to change the cleaning roller 10 each time it is stained. Therefore, high reliability and maintenance-free construction demanded for computer network systems, etc. can be achieved.

<Third Embodiment>

Figure 3:
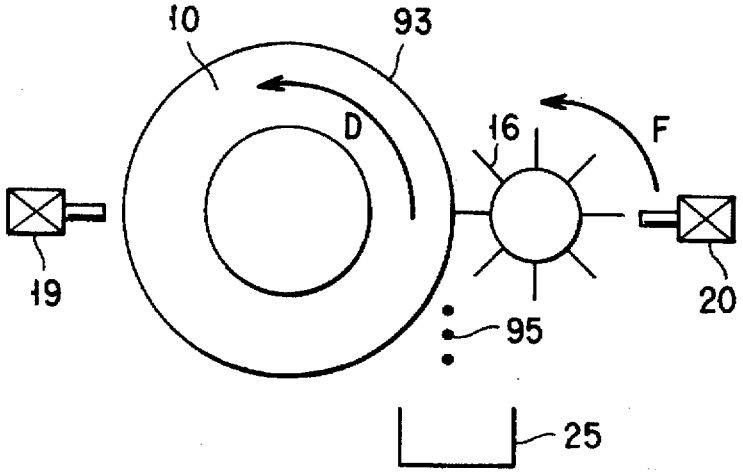
FIG. 3 shows a cleaning device according to a third embodiment of the invention.

A cleaning device according to a third embodiment of the invention will now be described with reference to FIG. 3. The cleaning device of this embodiment is applicable to the image forming apparatuses shown in FIGS. 1 and 2. FIG. 3 shows the state of the cleaning device in the refresh mode.

The cleaning roller 10, to which the residual toner 92 on the endless belt 2 (in the case of the apparatus shown in FIG. 1) or on the heat roller 8 of the fixing device 107 (in the case of the apparatus shown in FIG. 2) has been adhered, is cooled and adhered toner 93 is solidified. The cleaning roller 10 is rotated by a cleaning roller driving motor 19. A refresh brush 16 so disposed as to come into contact with the cleaning roller 10 is rotated in a direction F by a refresh brush motor 20. Distal end portions of the brush 16 give shocks to the adhered toner 93 and break the toner 93, while raking off the toner 93 from the surface 11 of the cleaning roller 10. When the brush 16 was formed of a resilient, elastic resin, e.g. nylon, a strong shock could be given to the adhered toner and a good refresh effect was obtained.

The raked-off toner 93 was fallen as toner exfoliations 95 and recovered in a residual toner recovery tray 25.

By using the brush 16 as refresh member, cracks and unevenness were produced on the smooth surface of the adhered toner 93 which is, otherwise, not easily raked off, and thus the adhered toner layer 93 can be raked off. Thus, the refresh time for the cleaning roller 10 is shortened, and the adhered toner 93 can be completely removed. Moreover, since the adhered toner 93 can be broken and raked off by only the single refresh brush 16, the number of parts can be reduced and the structure of the apparatus is simplified.

<Fourth Embodiment>

Figure 4:
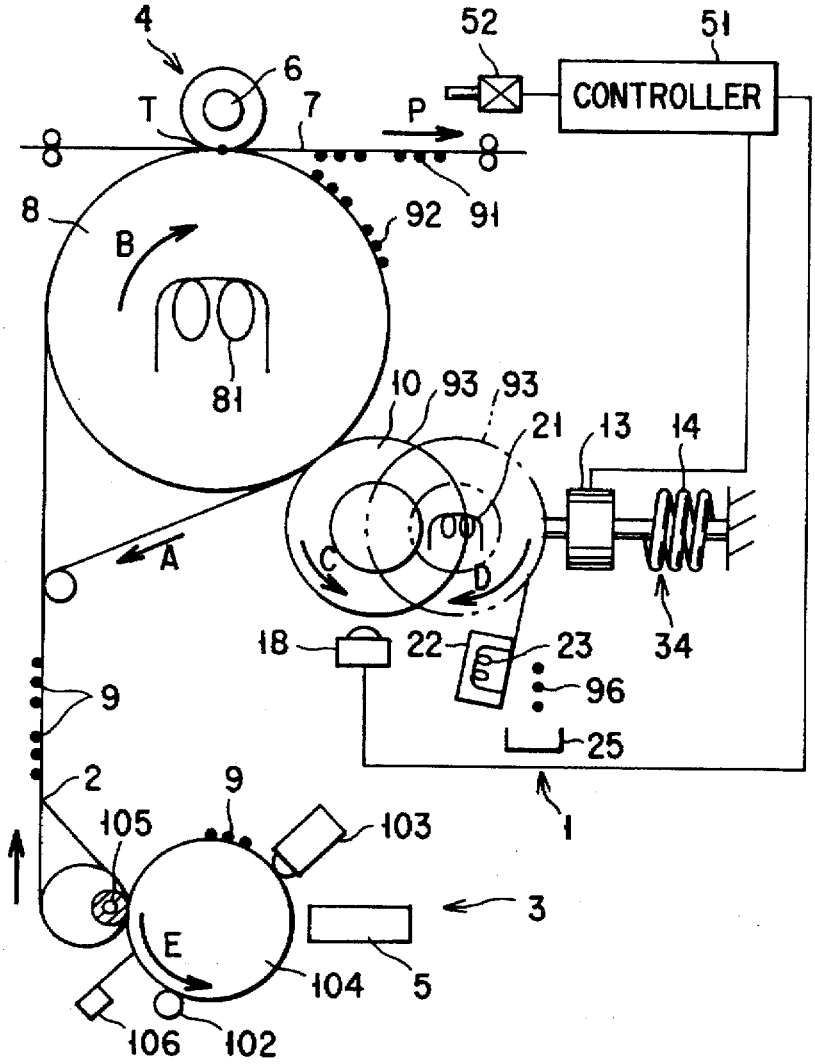
FIG. 4 shows an image forming apparatus having a cleaning device according to a fourth embodiment of the invention.

A cleaning device according to a fourth embodiment of the invention will now be described with reference to FIG. 4. FIG. 4 shows an image forming apparatus having the cleaning device of this embodiment.

An image forming process is performed in the following manner. An electrostatic latent image is formed on a drum 104 by means of an electrostatic image forming device 5, which is, for example, an ion stream control type recording device or a device for forming a latent image by a laser beam, etc. after uniformly charging the drum 104. Then, the drum 104 is rotated in a direction E, and toner is adhered to the electrostatic latent image by a developing device 103. Thus, a toner image 9 is formed and the electrostatic latent image is made visible. The toner image 9 on the drum 104 is transferred onto an endless belt 2 by means of a transfer member 105. The transfer member 105 is one of an electric transfer member, a pressure type transfer member, and a thermal transfer member. Then, the endless belt 2 is moved between a heat roller 8 and a pressing roller 6 along with a recording paper sheet 7 conveyed in a direction P. The endless belt 2 bearing the toner image 9 is heated on the reverse side thereof by the heat roller 8, and the toner image 9 on the endless belt 2 is softened. The toner image 9 is thermally transferred onto the recording sheet 7 and at the same time the toner image 9 is pressed by the pressing roller 6 and fixed on the recording sheet 7. Then, the recording sheet 7 and the endless belt 2 are separated by a separating device (not shown), and the recording sheet 7 is discharged to a discharge tray (not shown), etc.

The transfer ratio of toner onto the recording sheet, however, is not 100%. A small amount of residual molten toner 92 is left on the endless belt 2. The residual toner 92 is removed by a cleaning roller 10, the surface of which is covered with a resin or rubber having a surface energy greater than that of the surface of the endless belt 2.

If a controller 51 determines, on the basis of information from a stain sensor 18, that the cleaning performance of the cleaning roller 10 has been degraded, the cleaning roller 10 which is in contact with the endless belt 2 and rotated in a direction C, is separated from the endless belt 2 by an electromagnetic clutch 13 and a spring 14 which constitute a contacting/separating mechanism 34.

The cleaning roller 10 is heated by a cleaning roller heater 21 up to a temperature higher than the temperature at the cleaning time. Thereby, the viscosity of the toner 93 adhering to the cleaning roller 10 decreases, and the toner 93 becomes semifluid. When the cleaning roller 10 is situated in the refresh mode position (indicated by a two-dot-and-dash line), a refresh blade 22 provided with a refresh blade heater 23 is put in contact with the cleaning roller 10 and the cleaning roller 10 is rotated in a direction D. As a result, the semifluid adhered toner 93 is easily removed from the surface 11 of the cleaning roller 10. Removed toner drops 96 are recovered in a residual toner recovery tray 25. Accordingly, as compared to a mechanical removal method, the amount of flying toner is less at the time of breaking the residual toner. In addition, since the residual toner is recovered in a liquid phase, a recovery tray may have a small receiving opening and a small capacity.

Furthermore, when abnormality such as a jam occurs and the operation of the image forming apparatus is emergently halted, many toner images 9 remain on the endless belt 2 as residual toner 92. When the image forming apparatus is restarted after the emergency halt, the belt driving motor 52 is rotated in a speed lower than a normal speed by a command from the controller 51. Thus, even if a great deal of residual toner 92 occurs, the cleaning roller 10 exactly performs the cleaning operation.

As has been described above, the cleaning roller 10, which has been a consumable part in the prior art, can be easily and completely refreshed and need not be replaced with a new one. Thus, the running cost is reduced and the maintenance cost on the side of the user is decreased. Unlike the prior art, there is no need to change the cleaning roller 10 each time it is stained. Therefore, high reliability and maintenance-free construction demanded for computer network systems, etc. can be achieved. Furthermore, the image quality is stabilized even after an emergency halt due to a jam, etc.

<Fifth Embodiment>

Figure 5:
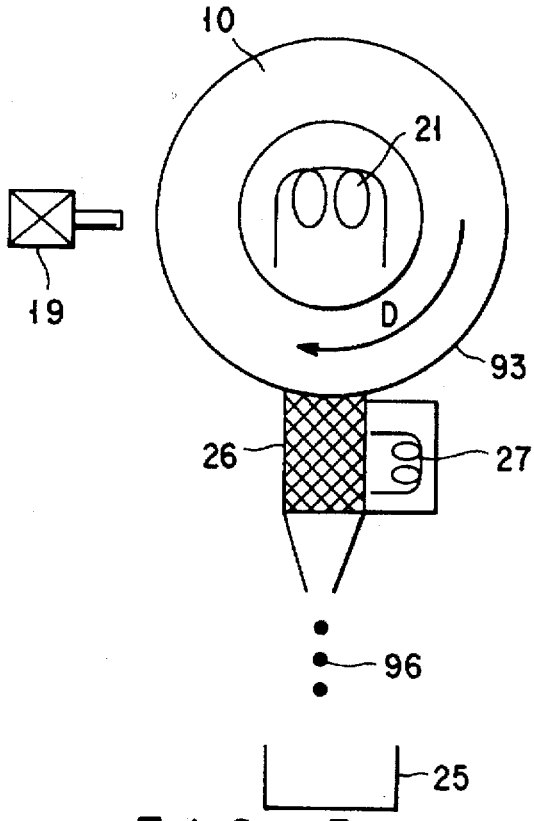
FIG. 5 shows a cleaning device according to a fifth embodiment of the invention.

A cleaning device according to a fifth embodiment of the invention will now be described with reference to FIG. 5. The cleaning device of this embodiment is applicable to the image forming apparatus shown in FIG. 1, 2 or 4. FIG. 5 shows the state of the cleaning device in the refresh mode.

The cleaning roller 10, to which the residual toner 92 on the endless belt 2 (in the case of the apparatus shown in FIG. 1 or 4) or on the heat roller 8 of the fixing device 107 (in the case of the apparatus shown in FIG. 2) has been adhered, is heated by a cleaning roller heater 21 until the viscosity of the adhered toner 93 decreases and the toner 93 is set in the semiliquid state. The cleaning roller 10 is rotated in a direction D by a cleaning roller driving motor 19, while the surface of the cleaning roller 10 is being in contact with the refresh felt 26. The refresh felt 26 is provided with a refresh felt heater 27 functioning as heating means. Accordingly, the adhered toner 93 brought into contact with the heated refresh felt 26 is further heated, softened and liquefied. The liquefied toner 93 is absorbed in the refresh felt 26. Then, the absorbed liquefied toner falls from the refresh felt 26 in the form of toner drops 96 and is recovered in a residual toner recovery tray 25.

<Sixth Embodiment>

Figure 6:
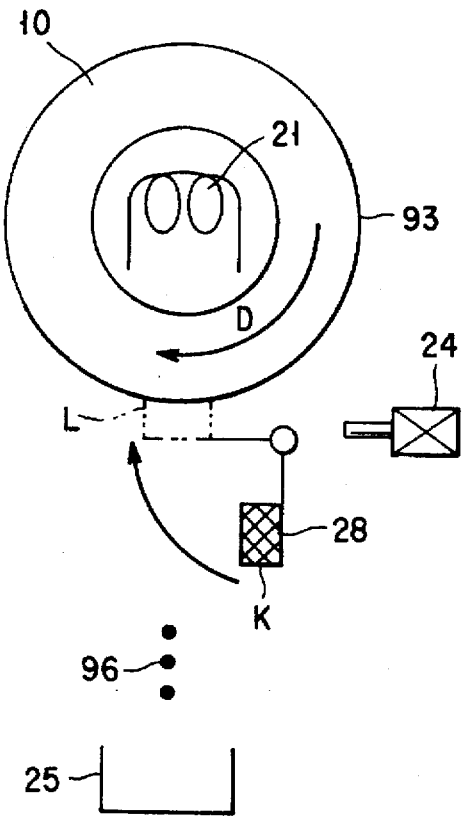
FIG. 6 shows a cleaning device according to a sixth embodiment of the invention.

A cleaning device according to a sixth embodiment of the invention will now be described with reference to FIG. 6. The cleaning device of this embodiment is applicable to the image forming apparatus shown in FIG. 1, 2 or 4. FIG. 6 shows the state of the cleaning device in the refresh mode.

The cleaning roller 10, to which the residual toner 92 on the endless belt 2 (in the case of the apparatus shown in FIG. 1 or 4) or on the heat roller 8 of the fixing device 107 (in the case of the apparatus shown in FIG. 2) has been adhered, is heated by a cleaning roller heater 21 until the adhered toner 93 is softened and liquefied. As a result, the liquefied toner 93 falls from the cleaning roller 10 by its own weight in the form of toner drops 96 and is recovered in a residual toner recovery tray 25.

Although a toner liquid drop stays on a lowermost portion of the cleaning roller 10, it is removed by a wipe-off member 28. The wipe-off member 28 is rotatable by a wipe-off member rotating motor 24 between positions K and L. At the position L, the wipe-off member 28 is in contact with the lowermost portion of the cleaning roller 10 so as to remove the toner liquid drop.

Since a refresh member, etc. is not slid on the cleaning roller surface 11, the cleaning roller 10 is not worn down. Since the toner drop staying on the lowermost portion of the cleaning roller 10 is absorbed by the toner wipe-off member 28, the residual toner 93 on the cleaning roller surface 11 is completely removed.

<Seventh Embodiment>

Figure 7:
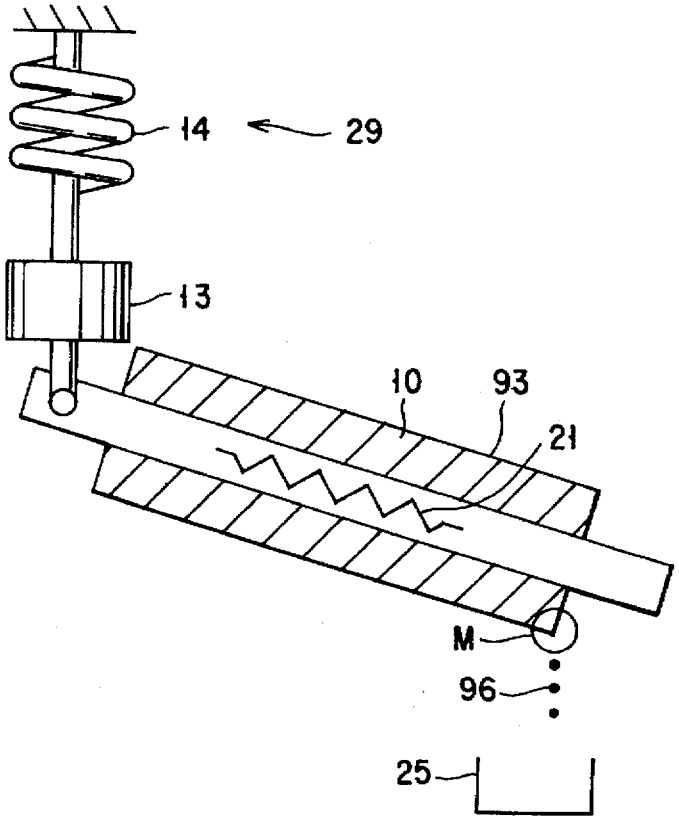
FIG. 7 shows a cleaning device according to a seventh embodiment of the invention.

A cleaning device according to a seventh embodiment of the invention will now be described with reference to FIG. 7. The cleaning device of this embodiment is applicable to the image forming apparatus shown in FIG. 1, 2 or 4. FIG. 7 shows the state of the cleaning device in the refresh mode.

The cleaning roller 10, to which the residual toner 92 on the endless belt 2 (in the case of the apparatus shown in FIG. 1 or 4) or on the heat roller 8 of the fixing device 107 (in the case of the apparatus shown in FIG. 2) has been adhered, is inclined by a cleaning roller inclining apparatus 29 comprising an electromagnetic clutch 13 and a spring 14. The cleaning roller 10 is heated by a cleaning roller heater 21 and the adhered toner 93 is softened and liquefied. The liquefied toner 93 moves to an edge portion M of the cleaning roller 10 by its own weight and stays at the edge portion M. Then, the liquefied toner 93 falls in the form of toner drops 96 and is recovered in a residual toner recovery tray 25.

Although the toner drop remains on the edge portion M of the cleaning roller 10, the edge portion M is located outside an image region and therefore there is no need to wipe off the toner drop on the edge portion M. Accordingly, the structure of the apparatus is simplified.

Since the toner drops 96 fall down to one place, the size of the residual toner recovery tray 25 can be reduced.

<Eighth Embodiment>

Figure 8:
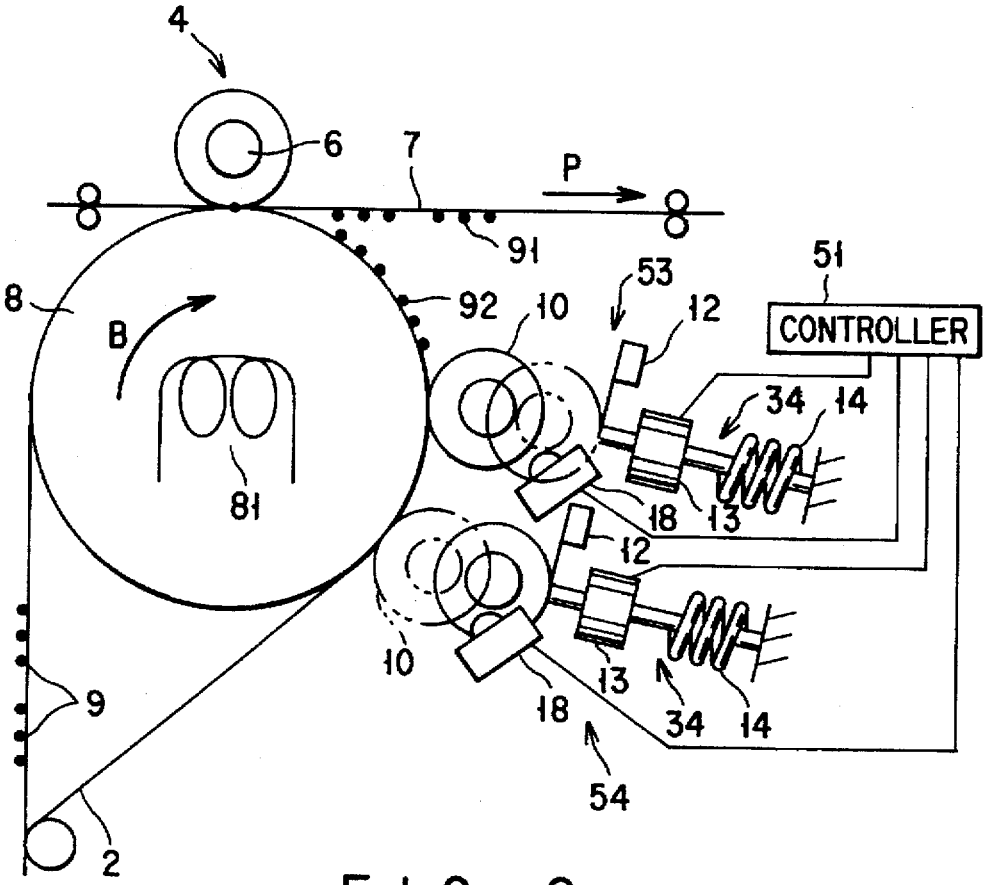
FIG. 8 shows a cleaning device according to an eighth embodiment of the invention.

A cleaning device according to an eighth embodiment of the invention will now be described with reference to FIG. 8. FIG. 8 shows a part of an image forming apparatus using the cleaning device of this embodiment.

An endless belt 2 bearing a toner image 9 is transferred between a heat roller 8 and a pressing roller 6 along with a recording paper sheet 7 conveyed in a direction P. The toner image 9 on the endless belt 2 is heated by the heat roller 8 and softened, and thermally transferred onto the recording sheet 7 at a thermal transfer position T. The toner image 9, which is transferred onto the recording sheet 7, is simultaneously pressed by the pressing roller 6 and fixed on the recording sheet 7.

A first cleaning unit 53 and a second cleaning unit 54 are provided on the downstream side of the thermal transfer position T. Cleaning rollers 10 of the cleaning units 53 and 54 can be independently put in contact with the endless belt 2 and separated from the endless belt 2 by means of associated cleaning roller contacting/separating mechanisms 34. FIG. 8 shows the state in which the cleaning roller 10 of the first cleaning unit 53 is put in contact with the endless belt 2, while the cleaning roller 10 of the second cleaning unit 54 is separated from the endless belt 2.

Residual toner 92, which has not been transferred by the thermal transfer unit 4 and remains on the endless belt 2, adheres to the cleaning roller 10 of the first cleaning unit 53 put in contact with the endless belt 2. Thus, the surface of the endless belt 2 is cleaned for the subsequent process.

On the other hand, the cleaning roller 10 of the second cleaning unit 54 is separated from the endless belt 2 by the cleaning roller contacting/separating mechanism 34. In this separated position, the toner on the cleaning roller 10 is removed by a refresh blade 12. It should be noted that the combination of the first and second cleaning units 53 and 54 may be a combination of the cleaning devices shown in the first to seventh embodiments The contacting/separating operations for the cleaning rollers 10 of the two cleaning units 53 and 54 are controlled by a controller 51 in response to stain signals from stain sensors 18. In the normal state, the cleaning roller 10 of one of the cleaning units, 53 (or 54), is put in contact with the endless belt 2, and the cleaning roller 10 of the other cleaning unit, 54 (or 53), is separated from the endless belt 2. The stain on the cleaning roller 10 put in contact with the endless belt 2 is monitored by the stain sensor 18. If the stain on the cleaning roller 10 is sensed by the controller 51 on the basis of the stain signal from the stain sensor 18, the cleaning roller 10 of the other cleaning unit is put in contact with the endless belt 2. Then, the former cleaning roller 10 is separated from the endless belt 2 and refreshed. Thus, the cleaning roller 10 can be refreshed without halting the operation of the image forming apparatus.

Furthermore, when abnormality such as a jam occurs and the operation of the image forming apparatus is emergently halted, many toner images 9 remain on the endless belt 2 as residual toner 92. When the image forming apparatus is restarted after the emergency halt, both the cleaning rollers 10 of the two cleaning units 53 and 54 are put in contact with the endless belt 2 by commands from the controller 51 and the residual toner 92 is surely removed even if the amount thereof is great.

In addition, the same advantage is obtained even in the case where the object to be cleaned is the heat roller 8 of the fixing device 107.

As has been described above, the image forming apparatus can be driven continuously without degrading the image quality. Thus, high reliability and maintenance-free construction demanded for computer network systems, etc. can be achieved. Furthermore, the image quality is stabilized even after an emergency halt due to a jam, etc.

<Ninth Embodiment>

Figure 9:
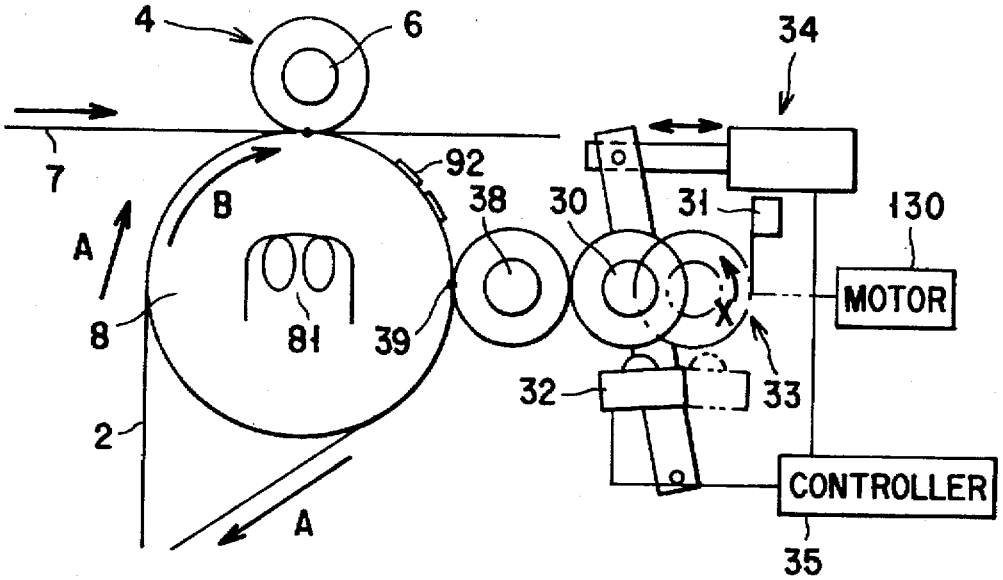
FIG. 9 shows a cleaning device according to a ninth embodiment of the invention.

A cleaning device according to a ninth embodiment of the invention will now be described with reference to FIG. 9. FIG. 9 shows a part of an image forming apparatus using the cleaning device of this embodiment.

Residual toner 92 on the endless belt 2 is melted by the heat of a heat roller 8, and the molten toner 92 is transferred onto a cleaning roller 38 coated with silicone and driven by the endless belt 2 with which the cleaning roller 38 is put in pressure contact, in a cleaning position 39 where the heat roller 8 is in contact with the endless belt 2. The molten residual toner 92 transferred onto the cleaning roller 38 is then transferred onto a refresh roller 30 coated with polyimide and driven by the cleaning roller 38 with which the refresh roller 30 is put in pressure contact.

Since the surface energy of the refresh roller 30 is greater than that of the cleaning roller 38, the residual toner 92 once adhered to the refresh roller 30 does not readhere to the cleaning roller 38.

A stain on the surface of the refresh roller 30 is optically monitored by a stain sensor 32. If the degree of stain on the surface of the refresh roller 30 reaches a predetermined level, a controller 35 activates a contacting/separating mechanism 34. As a result, the refresh roller 30 and stain sensor 32 are moved to a roller refresh position 33. While the refresh roller 30 is rotated in a direction X by a driving motor 130, the roller 30 is brought into contact with a refresh blade 31.

In the roller refresh position 33, the residual toner 92 on the refresh roller 30 is cooled by the surrounding atmosphere with an ambient temperature and solidified. The solidified toner 92 is raked off from the refresh roller 30 by a refresh blade 31.

If the degree of the stain on the refresh roller 30 decreases to a predetermined level, the controller 35 activates the contacting/separating mechanism 34 and brings the refresh roller 30 back into contact with the cleaning roller 38. Thus, the refresh roller 30 removes the residual toner 92 adhered to the cleaning roller 38 once again.

There is a concern that the cleaning of the endless belt 2 becomes inadequate while the refresh roller 30 is shifted to the roller refresh position 33. However, since the amount of the residual toner 92 on the endless belt 2 is small, the cleaning roller 38 can independently clean the endless belt 2 without problem for such a short time as the refresh time for the refresh roller 30.

The device of this embodiment has the following advantages.

The molten residual toner 92 transferred from the cleaning roller 38 onto the refresh roller 30 can be solidified on the refresh roller 30 and removed, while the cleaning roller 38 is kept in contact with the endless belt 2. Thus, the cleaning operation is not interrupted in order to maintain the cleaning performance.

In addition, the running cost is reduced since the cleaning roller 38 and refresh roller 30 can be used semipermanently. In addition, since the cleaning roller does not rub the surface of the cleaning roller, the wear of the surface of the endless belt is prevented and the durability of the endless belt is increased.

<Tenth Embodiment>

Figure 10A:
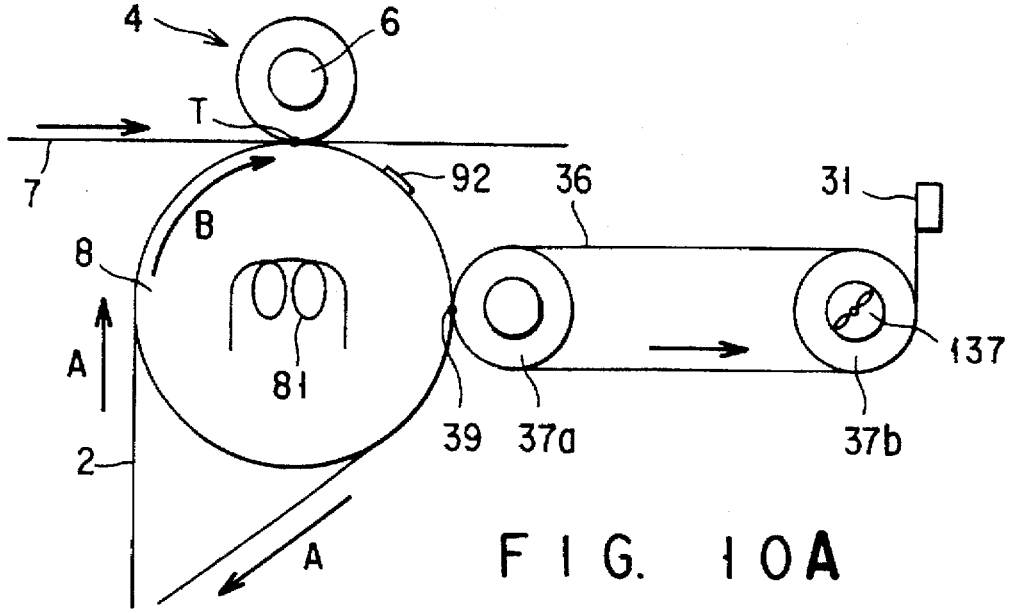
FIG. 10A shows a cleaning device according to a tenth embodiment of the invention.

A cleaning device according to a tenth embodiment of the invention will now be described with reference to FIG. 10A. FIG. 10A shows a part of an image forming apparatus using the cleaning device of this embodiment.

Residual toner 92 on an endless belt 2 is melted by the heat of a heat roller 8. The molten toner 92 is thermally transferred onto a cleaning belt 36 in a cleaning position 39. The cleaning belt 36 is formed of a polyimide material 75 μm thick, put in pressure contact with the endless belt 2, and passed with tension between rotatable support rollers 37*a* and 37*b*.

The support roller 37*b* is cooled by air outside the apparatus, which is taken in by a fan motor 137 provided within the support roller 37*b*.

The refresh blade 31 is put in contact with the cleaning belt 36 on the support roller 37*b*.

The molten residual toner 92 removed in the cleaning position 39 is cooled and solidified by the cooled support roller 37*b*. The solidified residual toner 92 is easily wiped off by a refresh blade 31, and the cleaning belt 36 is refreshed.

Figure 10B:
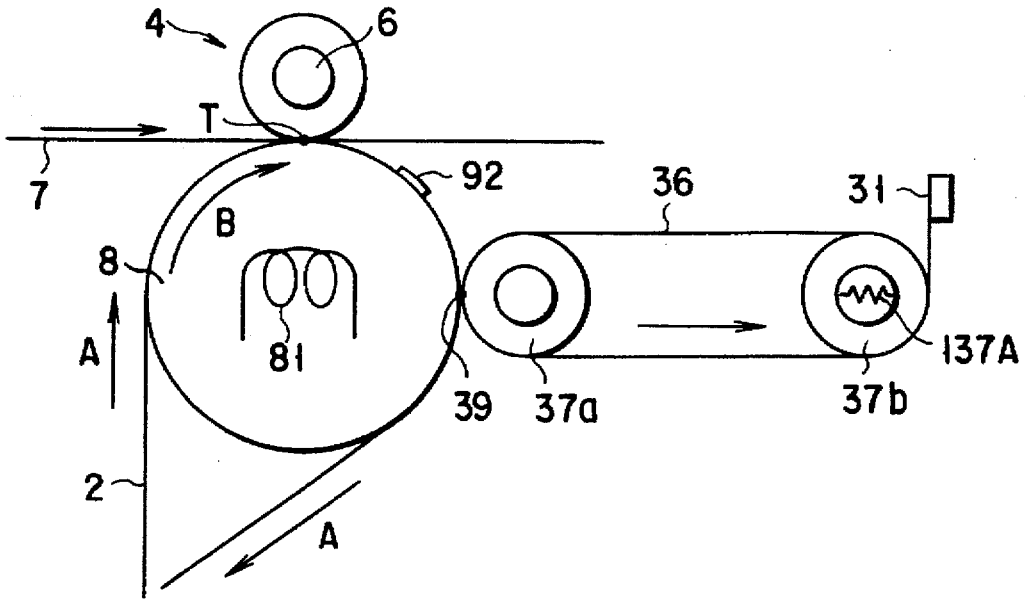
FIG. 10B shows another cleaning device according to the tenth embodiment of the invention.

In the present embodiment, the support roller 37*b* is cooled, and the residual toner 92 is solidified and removed by the refresh blade 31. Thereby, the cleaning belt 36 is refreshed. Alternatively, as shown in FIG. 10B, the support roller 37*b* may be heated by a heater 137A and the residual toner 92 in the molten state may be removed, thereby to refresh the cleaning belt 36.

The apparatus of this embodiment has the following advantages.

Since the toner on the cleaning belt 36 is removed with the cleaning belt 36 kept in contact with the endless belt 2, there is no need to interrupt the cleaning operation in order to maintain the cleaning performance.

The running cost is reduced since the cleaning belt 36 can be used semipermanently. In addition, since the cleaning belt 36 is driven by the endless belt 2 and does not rub the endless belt 2, the wear of the surface of the endless belt is prevented and the durability of the endless belt is increased.

<Eleventh Embodiment>

Figure 11:
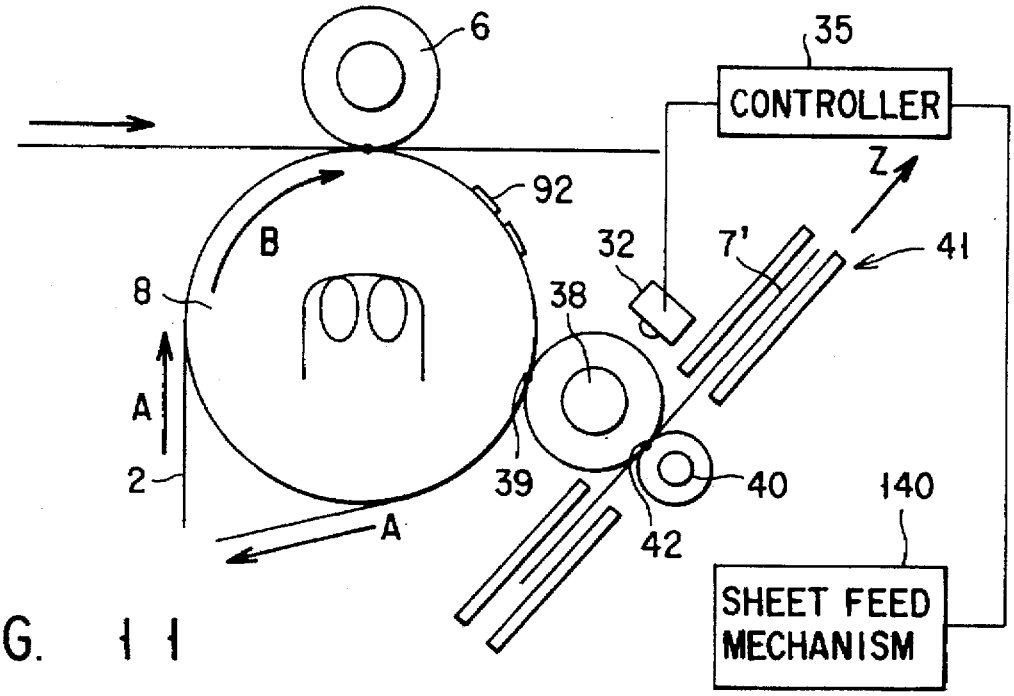
FIG. 11 shows a cleaning device according to an eleventh embodiment of the invention.

A cleaning device according to an eleventh embodiment of the invention will now be described with reference to FIG. 11. FIG. 11 shows a part of an image forming apparatus using the cleaning device of this embodiment.

Residual toner 92 on an endless belt 2 is melted by the heat of a heat roller 8, and the molten toner 92 is transferred at a cleaning position 39 onto a cleaning roller 38 coated with silicone and driven by the endless belt 2 with which the cleaning roller 38 is put in pressure contact. A pressing roller 40 coated with silicone is put in pressure contact with the cleaning roller 38 and driven by the cleaning roller 38. A stain sensor 32 for optically sensing a stain is situated to face the cleaning roller 38.

If the stain sensor 32 has detected that the degree of stain on the cleaning roller 38 reaches a predetermined level, a controller 35 activates a sheet feed mechanism 140 and a recording paper sheet 7' is fed to a refresh point 42 through a transfer path 41. The recording sheet 7' is clamped between the cleaning roller 38 and pressing roller 40 and moved in a direction Z. At this time, the molten residual toner 92 adhered to the cleaning roller 38 is transferred onto the recording sheet 7' and the surface of the cleaning roller 38 is cleaned. Then, the recording sheet 7' is discharged onto a tray (not shown).

The apparatus of this embodiment has the following advantages.

The cleaning roller 38 can be cleaned by the recording sheet 7', without using special paper. The recording sheet 7' is used only when the stain of the cleaning roller 38 is sensed and the cleaning is needed. Thus, the recording sheet 7' is not wasted.

Since the cleaning roller 38 is not separated from the endless belt 2 for the purpose of refreshing the cleaning roller, there is no need to suspend the cleaning operation in order to maintain the cleaning performance.

The replacement of the cleaning roller 38 is not needed, and the running cost is reduced.

<Twelfth Embodiment>

A cleaning device according to a twelfth embodiment of the invention will now be described with reference to FIGS. 12A to 12C.

Figure 12A:
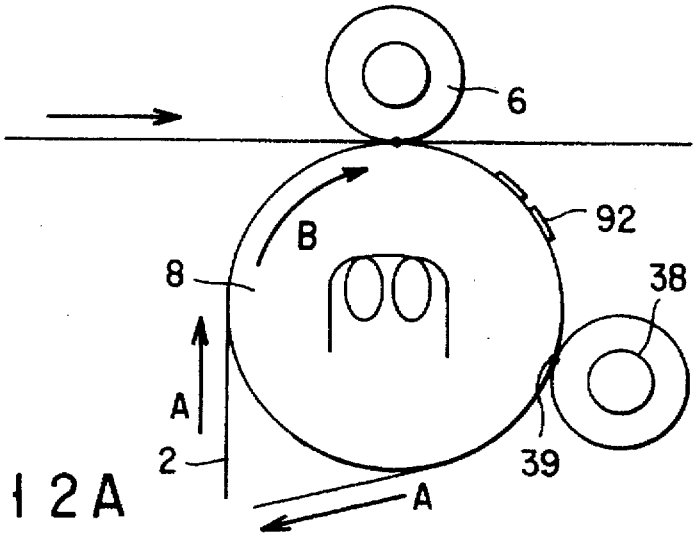
FIG. 12A shows a cleaning device according to a twelfth embodiment of the invention.

As is shown in FIG. 12A, residual toner 92 on an endless belt 2 coated with fluorine is melted by the heat of a heat roller 8, and the molten toner 92 is transferred at a cleaning position 39 onto a cleaning roller 38 put in pressure contact with and driven by the endless belt 2, in a cleaning position 39.

Figure 12B:
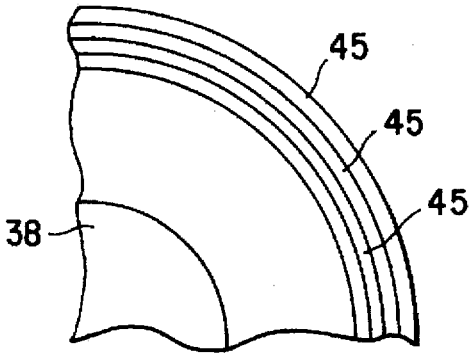
FIG. 12B shows a cross-sectional structure of a cleaning roller of the apparatus shown in FIG. 12A.

As is shown in FIG. 12B, a number of polyimide thin cleaning films 45 are wound around the cleaning roller 38. Each cleaning film 45 is 50 μn thick, and has a heat-resistant adhesive layer on the bottom side thereof and a surface energy higher than fluorine.

The molten residual toner 92 on the endless belt 2 is removed by the first thin cleaning film 45 on the cleaning roller 38. If the stain on the cleaning film 45 increases due to long-time use, the cleaning performance degrades. The stained first thin cleaning film 45 is removed and a second thin cleaning film 45 appears on the cleaning roller 38. Thus, the surface of the cleaning roller 38 is cleaned and the cleaning performance is restored to the original level.

Figure 12C:
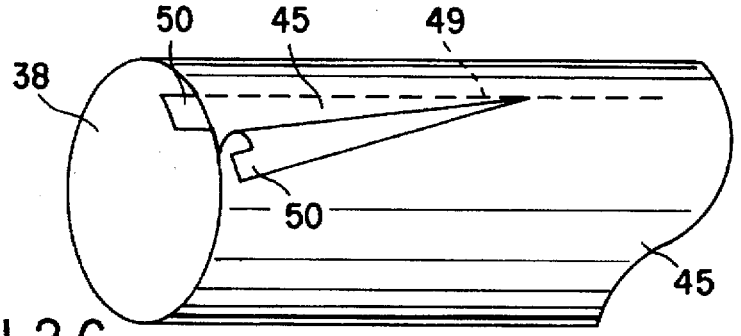
FIG. 12C shows the state in which a cleaning film shown in FIG. 12B is removed.

As shown in FIG. 12C, perforations 49 are formed in the thin cleaning films 45 in the longitudinal direction of the cleaning roller 38. Tabs 50 are provided outside the cleaning roller 38 along the perforations 49. The thin cleaning films 45 can be cut along the perforations 49 and peeled off one by one by pulling the tabs 50.

The apparatus of the present embodiment has the following advantages.

Since the cleaning performance is restored only by peeling off the thin cleaning film 45, without replacing the cleaning roller 38, the running cost is reduced and the maintenance is made easier.

Since the surface energy of the thin film cleaning film is greater than that of the endless belt 2, the cleaning performance of the cleaning film is high.

The thin cleaning films can be removed one by one, and the maintenance time is shortened.

<Thirteenth Embodiment>

Figure 13:
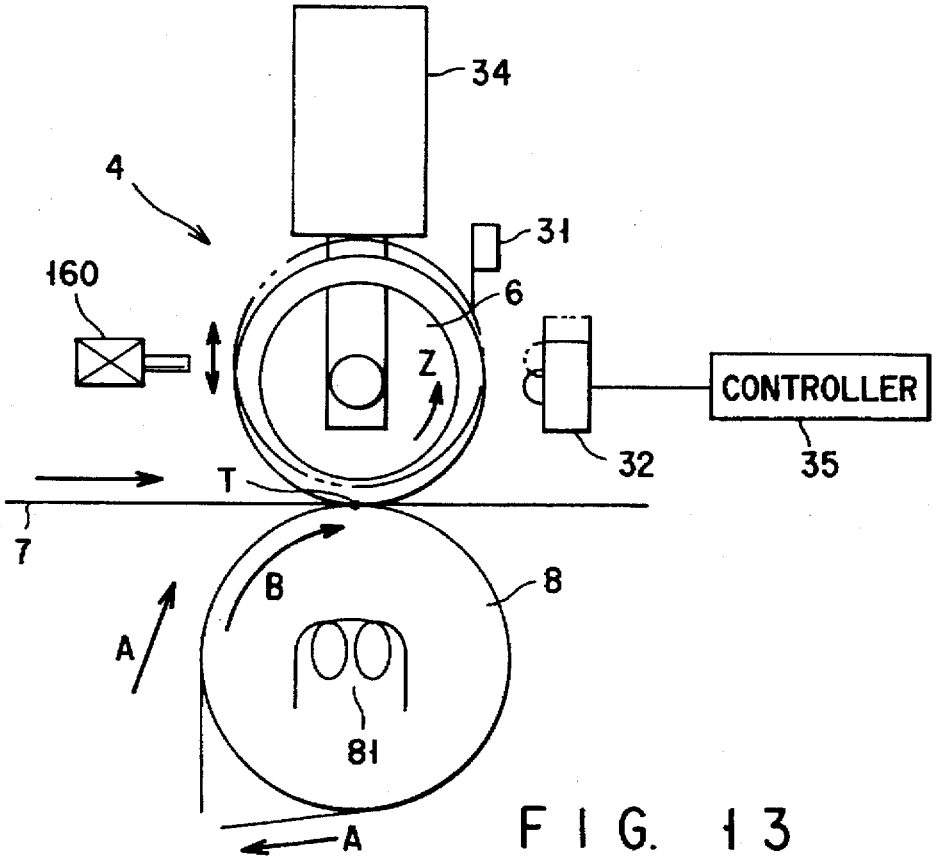
FIG. 13 shows a transfer device serving also as cleaning device, according to a thirteenth embodiment of the invention.

A thirteenth embodiment of the invention will now be described with reference to FIG. 13.

A pressing roller 6 is coated with polyimide. The pressing roller 6 comes into pressure contact with a heat roller 8 at a thermal transfer position T, and the pressing roller 6 is driven by the heat roller 8.

The pressing roller 6 is separated from the heat roller 8 by means of a contacting/separating mechanism 34, and the pressing roller 6 comes into contact with a refresh blade 31. The pressing roller 6 is then rotated by a motor 160 in a direction Z. A stain sensor 32 for optically sensing a stain on the pressing roller 6 is situated to face the pressing roller 6. The degree of the stain is sensed by a controller 35.

The pressing roller 6 is normally used as a pressing member for transferring and fixing a toner image 9 on a recording paper sheet 7. However, the pressing roller 6 is coated with polyimide having a higher surface energy than the endless belt 2 and, if residual toner 92 is present on the endless belt at the thermal transfer position T, the residual toner 92 adheres to the pressing roller 6. Thus, the pressing roller 6 is cleaned.

The optical stain sensor 32 and controller 35 determine the degree of stain on the pressing roller 6. If the level of the stain reaches a predetermined level, the contacting/separating mechanism 34 separates the pressing roller 6 from the thermal transfer position T and the pressing roller 6 comes into contact with the refresh blade 31. At the same time, the pressing roller 6 is rotated in a direction Z by the motor 160.

If the pressing roller 6 is separated from the thermal transfer position T, the residual toner 92 adhered to the pressing roller 6 is cooled and solidified and can be easily removed by the refresh blade 31.

The level of cleanness of the pressing roller 6 is determined by the stain sensor 32 and controller 35. After the pressing roller 6 has been cleaned, the contacting/separating mechanism 34 restores the pressing roller 6 to the thermal transfer position T.

The present embodiment wherein the pressing roller 6 is used as cleaner is more advantageous in the following use.

The pressing roller 6 is designed to function as a member for transferring the toner image 9 on the endless belt 2 onto the recording sheet 7 and is not put in direct contact with the endless belt 2 in the normal state. Thus, the endless belt is not cleaned by the pressing roller 6. However, since the thermal transfer ratio of toner image 9 is 95% or more, the endless belt 2 is not critically stained even without performing frequent cleaning. Continuous printing can be effected on at least about 100 sheets.

If the printing operation is suspended each time the printing of 100 sheets is finished, the degree of stain on the endless belt 2 can be limited to a certain level. Accordingly, even if a cleaning device for exclusive use is not provided, the image quality of the image forming apparatus can be stabilized.

In the case where an exclusive-use cleaning device is provided, when the operation of the apparatus is restarted after an emergency halt, etc., the un-transferred toner image 9 remaining on the endless belt 2 is effectively removed by using the pressing roller 6 in combination with the exclusive-use cleaning device originally provided in the apparatus.

The present embodiment has the following advantages.

If the endless belt is rotated during printing, the pressing roller can serve as cleaning device and the structure of the apparatus is simplified.

Since the pressing roller can be used as cleaning member at the time of the restart of the operation after an emergency halt, the cleaning efficiency for the endless belt is enhanced and the time until the restart is shortened.

Since the molten residual toner 92 transferred on the pressing roller 6 is solidified and removed, the pressing roller 6 can be stably refreshed with a simple mechanism. When the pressing roller 6 is used as a pressing member, the back side of the recording sheet is not stained.

<Fourteenth Embodiment>

Figure 14:
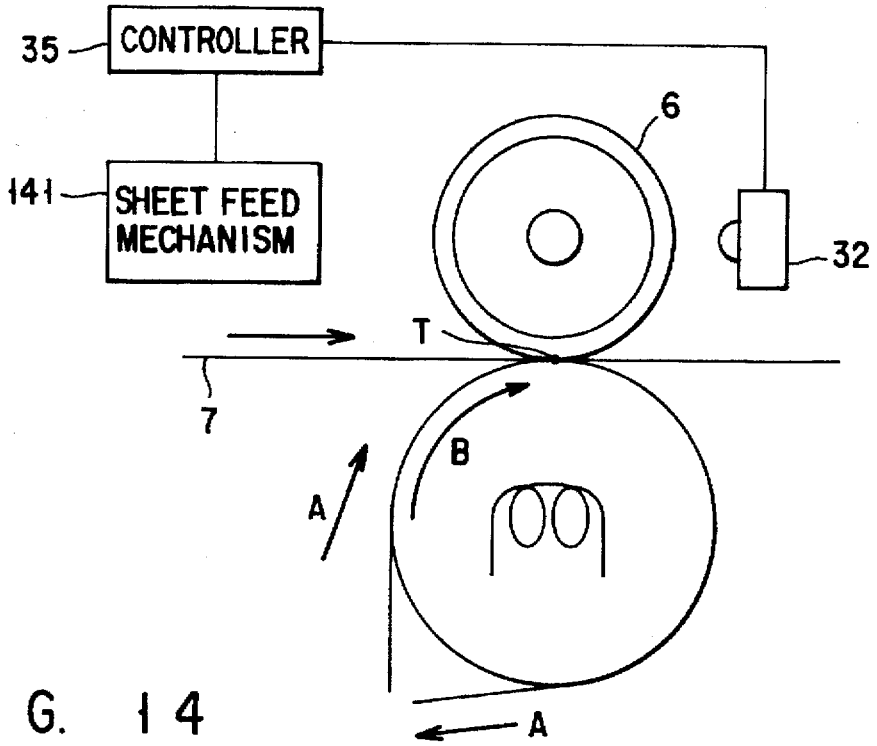
FIG. 14 shows a transfer device serving also as cleaning device, according to a fourteenth embodiment of the invention.

A fourteenth embodiment of the invention will now be described with reference to FIG. 14.

A pressing roller 6 is of 40ϕ and has a cylindrical surface coated with polyimide coating. The pressing roller 6 comes into pressure contact with a heat roller 8 at a thermal transfer position T, and the pressing roller 6 is driven by the heat roller 8 to remove residual toner on an endless belt 2.

An optical stain sensor 32 is situated to face the pressing roller 6. A controller 35 determines the degree of the stain on the pressing roller 6. If the degree of the stain has reached a predetermined value, a sheet-like cleaning member feed mechanism 141 is actuated to feed a sheet-like cleaning member to a thermal transfer unit. In this case, a sheet-like cleaning member having a length of more than about 125 mm or the circumferential length of the pressing roller 6 is selected as one to be fed.

The present embodiment has the following advantage.

The pressing roller can be refreshed only by feeding the sheet-like cleaning member, and a special cleaning mechanism for the pressing roller 6 is not needed.

<Fifteenth Embodiment>

Figure 15A:
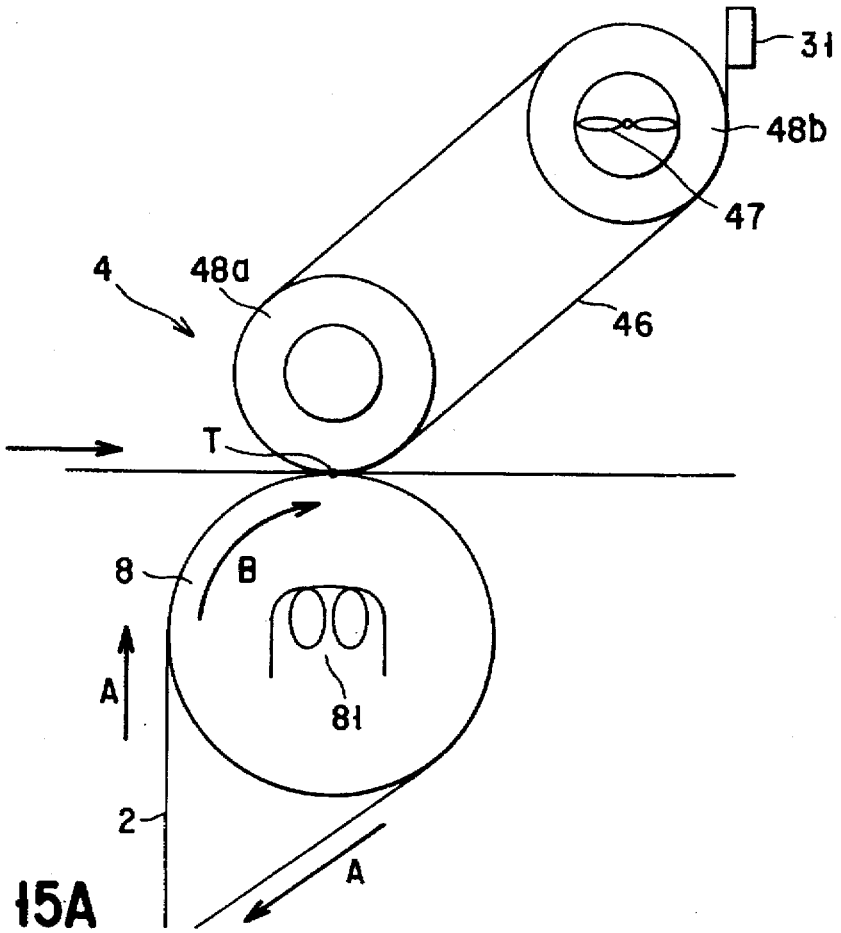
FIG. 15A shows a transfer device serving also as cleaning device, according to a fifteenth embodiment of the invention.

A fifteenth embodiment of the invention will now be described with reference to FIG. 15A.

A pressing belt 46 of polyimide with a thickness of 75 μm is held by two rotatable pressure support rollers 48*a* and 48*b* with tension. The pressure support roller 48*b* is cooled by a fan motor 47. A refresh blade 31 is put in contact with the pressing belt 46 on the pressure support roller 48*b*. The pressing belt 46 is brought into pressure contact with an endless belt 2 at a thermal transfer position T and is driven by the endless belt 2. During intervals of supply of recording sheets or while the supply of recording sheets is halted, the molten residual toner 92 on the endless belt 2 is thermally adhered to the pressing belt 46 at the thermal transfer position T. Thus, the endless belt 2 is cleaned.

Then, the molten residual toner 92 adhered to the pressing belt 46 at the thermal transfer position T is cooled by the cooled pressure support roller 48*b* and solidified. The solidified residual toner 92 is easily raked off by the refresh blade 31 and the pressing belt 46 is refreshed.

Figure 15B:
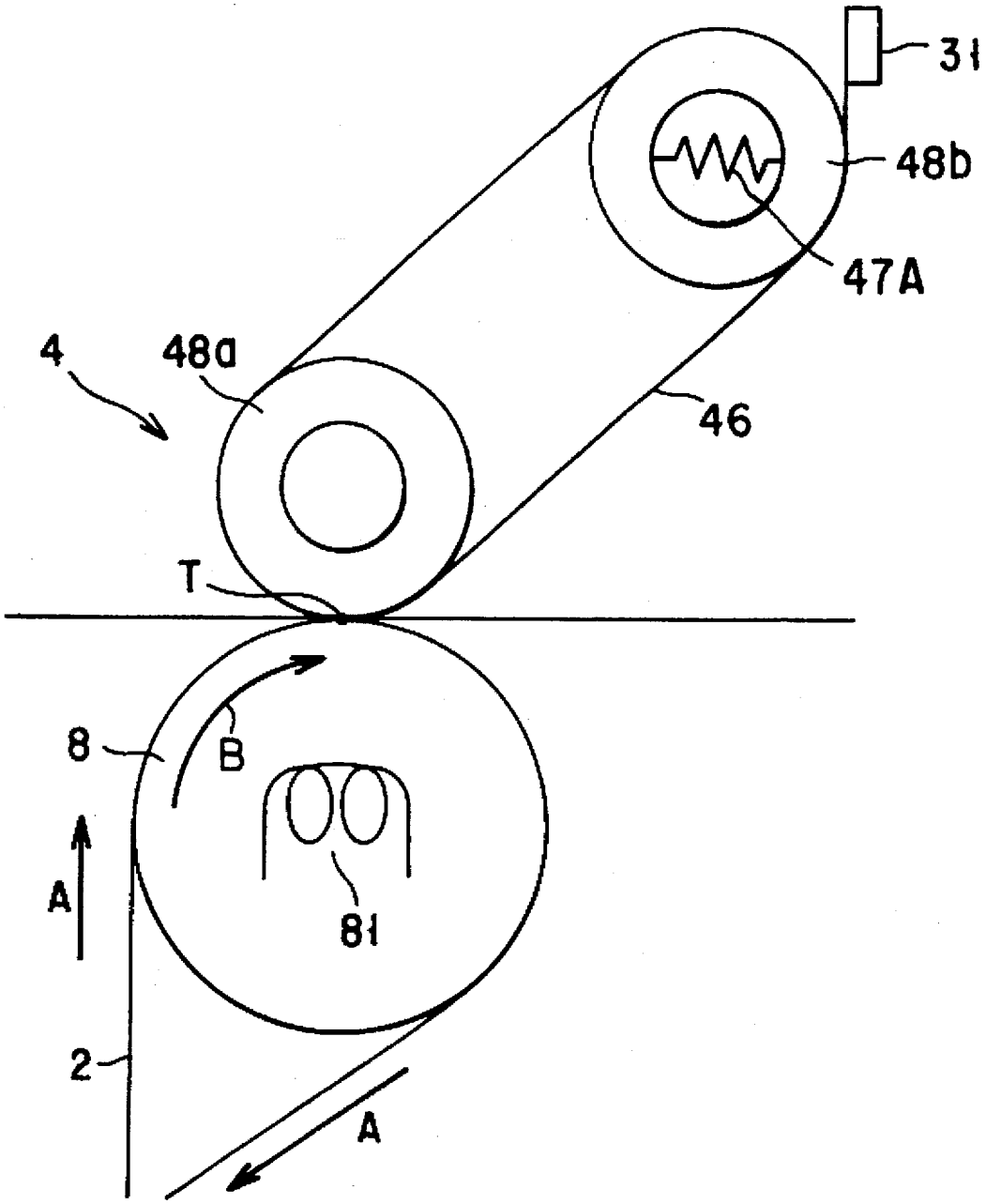
FIG. 15B shows another transfer device serving also as cleaning device, according to the fifteenth embodiment of the invention.

In the present embodiment, the pressure support roller 48*b* is cooled and the pressing belt 46 is refreshed by using the refresh blade 31. However, the pressure support roller 48*b* may be heated by a heater 47A to fully melt the residual toner 92 on the pressing belt 46, and then the pressing belt 46 may be refreshed, as shown in FIG. 15B.

The present embodiment has the following advantages.

Since the molten residual toner 92 on the pressing belt 46 with a cleaning function is cooled and solidified by the cooling device (fan motor 47), the pressing belt 46 can be refreshed continuously and stably with a simple mechanism.

Since the pressing belt 46 is not separated from the endless belt 2, the continuous printing need not be interrupted for the purpose of the refreshing operation.

Since the pressing belt can be used semi-permanently, the running cost can be reduced.

<Sixteenth Embodiment>

Figure 16:
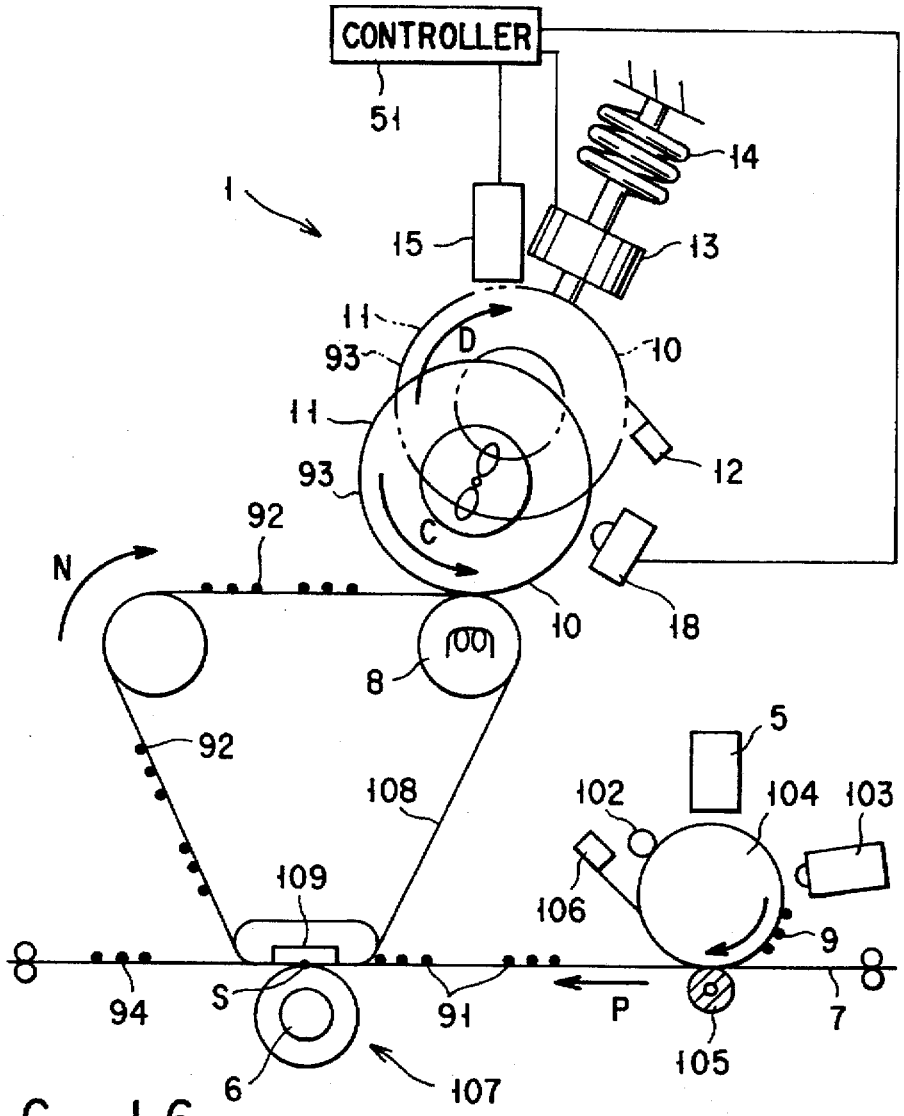
FIG. 16 shows an image forming apparatus having a cleaning device according to a sixteenth embodiment of the invention.

A cleaning device according to a sixteenth embodiment of the invention will now be described with reference to FIG. 16. FIG. 16 shows an image forming apparatus having the cleaning device of this embodiment.

The image forming process in this embodiment will now be described. An electrostatic latent image is formed on a drum 104 by an electrostatic image forming device 5. The electrostatic latent image is provided with toner by a developing device 103 and developed into a visible toner image 9. The toner image 9 on the drum 104 is transferred onto a recording paper sheet 7 (which is conveyed in a direction P) by a transfer member 105. The recording sheet 7 bearing the transferred toner image 91 in the non-fixed state is moved to a point S between a heater 109 and a pressing roller 6. The recording sheet 7 bearing the toner image 91 is heated by the heater 109 and the toner image 91 on the sheet 7 is softened and thermally fixed on the recording sheet 7. Thereafter, the recording sheet 7 is separated by a separating device (not shown).

When the fixed toner image 94 is separated from a fixing film 108 which runs in a direction N, a small amount of offset toner remains on the surface of the fixing film 108 as residual toner 92. The residual toner 92 will be fixed on the subsequent recording sheet and the image quality is degraded.

The cleaning device 1 includes a cleaning roller 10 driven by the fixing film 108 in a direction C. The residual toner 92 adheres to the surface of the cleaning roller 10 and is removed from the fixing film 108. Thereby, the image quality is stabilized.

The cleaning device 1 includes a vibration device 15 for beating a toner layer 93 formed of cooled and solidified toner on the cleaning roller 10. The vibrating device 15 beats the toner layer 93 of the cooled and solidified toner adhered to the surface of the cleaning roller 10, thus forming cracks or unevenness on the toner layer 93. The toner layer 93 with cracks or unevenness is easily raked off by a refresh blade 12. Since the toner layer 93 of the solidified toner adhered to the cleaning roller 10 has a smooth surface, the refresh blade 12 is not easily caught on the smooth surface. However, if the smooth surface is beaten by the vibrating device 15, the smooth surface is cracked or roughened and is easily caught by the refresh blade 12. Thereby, the refresh time for the cleaning roller 10 is shortened, and the adhered toner is completely removed.

This completely refreshed cleaning roller 10 can clean the heat roller 8 once again, and there is no need to replace the cleaning roller 10.

In a regular fixing device, residual toner is cleaned by putting a felt pad, a web, etc. into contact with the toner. As the residual toner adheres to the pad, web, etc., however, the cleaning performance deteriorates and the image quality becomes unstable. In order to stabilize the image quality, cleaning members are frequently replaced, resulting in an increase in the running cost and a high maintenance cost on the side of the user. Besides, the reliability of the image forming apparatus is considerably degraded. Consequently, high reliability and maintenance-free construction demanded for computer network systems, etc. cannot be achieved.

In the present embodiment, the fixing film 108 of the fixing device 107 is cleaned by the cleaning roller 10 driven by the fixing film 108, and the adhered toner 93 on the cleaning roller 10 is easily and completely removed. Thus, the cleaning roller 10 can be used permanently. Accordingly, the running cost is decreased and the maintenance cost on the side of the user is reduced. Unlike the prior art, there is no need to change the cleaning roller 10 each time it is stained. Therefore, high reliability and maintenance-free construction demanded for computer network systems, etc. can be achieved.

<Seventeenth Embodiment>

Figure 17:
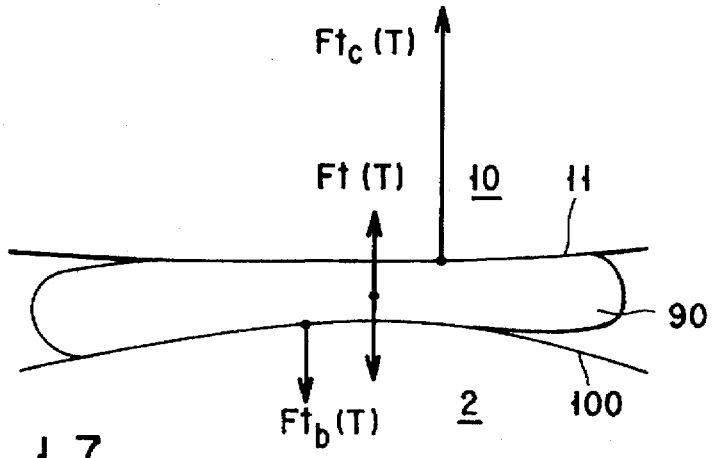
FIG. 17 illustrates, as a seventeenth embodiment of the invention, the principle of cleaning in the preceding embodiments.

With reference to FIG. 17, the principle of cleaning in the preceding embodiments will now be described as a seventeenth embodiment of the invention.

For example, in the first embodiment (FIG. 1), the residual toner 92, which has not been transferred onto the recording sheet, is moved along with the endless belt 2 to the contact portion between the endless belt 2 and the cleaning roller 10. A residual toner mass 90 is put in contact with both the surface 100 of the endless belt 2 and the surface 11 of the cleaning roller 10, as shown in FIG. 17. The force acting on the residual toner 92 at the contact point between the surface 11 of the cleaning roller 10 and the surface 100 of the endless belt 2 consists of an adhesive force $F_{tc}(T)$ acting between the residual toner mass 90 and the surface 11 of the cleaning roller 10 and an adhesive force $F_{tb}(T)$ acting between the residual toner 90 and the surface 100 of the endless belt 2. Since the surface 11 of the cleaning roller 10 is coated with a member having a greater surface energy than the surface 100 of the endless belt 2, the following formula is obtained:

$$F_{tc}(T)>F_{tb}(T)$$

Accordingly, when the endless belt 2 is separated from the cleaning roller 10, the residual toner mass 90 adheres to the surface 11 of the cleaning roller 10 having the higher surface energy. In the present embodiment, use is made of not the capillary action of a wipe-off felt but the adhesive force of the member with the higher surface energy. Thus, cleaning with no residual toner can be performed.

If the temperature of the residual toner mass 90 is too low, the cohesive force $F_t(T)$ acting among toner particles of the residual toner mass weakens and part of the toner mass is torn off and left behind on the surface 100 of the endless belt 2. Thus, the temperature of the surface 11 of the cleaning roller 10 must be controlled so that the temperature of the residual toner mass 90 reaches a glass transition point or above. As a result, the cohesive force $F_t(T)$ of the residual toner mass 90 is set to be higher than the adhesive force $F_{tb}(T)$ between the residual toner mass 90 and the surface 100 of the endless belt 2.

On the other hand, if the temperature of the residual toner mass 90 is too high, the viscosity of the residual toner mass 90 lowers and the toner mass 90 liquefies. As a result, the cohesive force $F_t(T)$ of the residual toner mass 90 weakens and part of the toner mass is torn off and left behind on the surface 100 of the endless belt 2. Thus, the temperature of the surface 11 of the cleaning roller 10 must be controlled so that the temperature of the residual toner mass 90 may be set at a level at which the toner mass 90 does not liquefy, preferably at a level not higher than the surface temperature of the endless belt 2 of the thermal transfer unit. As a result, the cohesive force $F_t(T)$ of the residual toner mass 90 is set to be higher than the adhesive force $F_{tb}(T)$ between the residual toner mass 90 and the surface 100 of the endless belt 2.

Suppose that at the contact point between the cleaning roller 10 and endless belt 2, the adhesive force between the residual toner mass 90 and the surface 11 of the cleaning roller 10 is $F_{tc}(T)$, the cohesive force of the residual toner mass 90 is $F_t(T)$, and the adhesive force between the residual toner mass 90 and the surface 100 of the endless belt 2 is $F_{tb}(T)$. In this case, since the temperature of the surface 11 of the cleaning roller 10 is not lower than the toner glass transition point and is not higher than the temperature of the surface 100 of the endless belt 2 of the thermal transfer unit, the following formula is obtained:

$$F_{tc}(T)>F_t(T)>F_{tb}(T)$$

By setting the surface temperature of the cleaning roller, as stated above, the residual toner particles soften, melt and cohere. Thus, the residual toner mass 90 behaves as one body, and the residual toner mass 90 is removed by the adhesive force between the toner mass 90 and the surface 11 of the cleaning roller 10.

In addition, since the surface of the cleaning roller 10 is coated with the elastic member 11, the endless belt 2 and cleaning roller 10 are prevented from wearing down. The elastic member 11 is formed of a heat-resistant resin or rubber which does not damage the endless belt 2 and has a greater surface energy than the surface of the endless belt 2. Examples of the resin are phenol resin, melamine resin, aryl resin, furan resin, unsaturated polyester resin, alkyd resin, epoxy resin, silicone resin, polyimide, polyamideimide, polyethersulfone, polysulfone, polyarylether, polyarylsulfone, polybutadiene, fluoroplastics, thermoplastic polyester, and polyphenylene sulfide. Examples of the rubber are chloroprene acryl rubber, nitrile butadiene rubber, isobutylen isoprene rubber, ethylene propylene rubber, silicone rubber, chlorosulfonated polyethylene rubber, chlorinated polyethylene rubber, acryl rubber, and epichlorohydrin rubber.

In FIG. 1, the cleaning roller 10 is put in contact with the endless belt 2 and rotated in the direction A of movement of the endless belt 2. The softened residual toner 92 adheres to the surface of the cleaning roller 10 by the adhesive force acting between the residual toner 92 and the surface of the cleaning roller 10. As a result, the surface of the endless belt 2 is cleaned. According to the experiments made by the inventors, good results were obtained when the elastic member was formed of polyimide, MYLAR™ (polyester film) polyolefin resin, or silicone rubber.

Thus, the cleaning device with high cleaning performance and less wear of the endless belt 2 is achieved.

<Eighteenth Embodiment>

Figure 18:
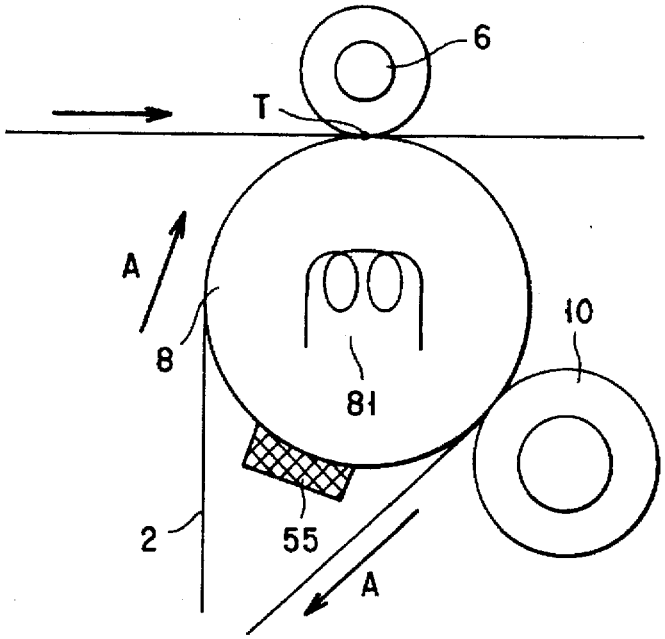
FIG. 18 shows a cleaning device according to an eighteenth embodiment of the invention.

An eighteenth embodiment of the invention will now be described with reference to FIGS. 1 and 18. The present embodiment is an improvement of the apparatus shown in FIG. 1, and FIG. 18 shows the improved part.

The endless belt 2 is passed between the visible image forming unit 3 provided in the lower part of the apparatus and the thermal transfer unit 4 provided in the upper part of the apparatus. The image forming process is performed in the following manner. An electrostatic latent image is formed on the endless belt 2 by the electrostatic image forming device 5, which is, for example, an ion stream control type recording device or a device for forming a latent image by a laser beam, etc. after uniformly charging the endless belt 2. Then, toner is adhered to the electrostatic latent image by the developing device 103. Thus, a toner image 9 is formed and the electrostatic latent image is made visible. The endless belt 2 with the toner image 9 runs between the heat roller 8 and the pressing roller 6 along with a recording paper sheet 7. The endless belt 2 with the toner image 9 is heated on the reverse side thereof by the heat roller 8, and the toner image 9 on the endless belt 2 is softened. At the thermal transfer position T, the toner image 9 is thermally transferred onto the recording sheet 7 and at the same time the toner image 9 is pressed by the pressing roller 6 and fixed on the recording sheet 7. Then, the recording sheet 7 and the endless belt 2 are separated by a separating device (not shown), and the recording sheet 7 is discharged to a discharge tray (not shown), etc.

On the other hand, reverse side of the endless belt 2 is often stained with paper powder or abraded particles of the support rollers put in contact with the endless belt 2. If the degree of stain increases, the endless belt 2 may deform due to the paper powder or abraded particles interposed between the endless belt 2 and the heat roller 2 or support rollers. The deformation of the belt 2 results in irregular gaps in the developing device and electrostatic image forming device 5.

In addition, the electrically conductive abraded particles on the reverse side of the endless belt 2 may disperse within the apparatus and deteriorate the insulation of the electric parts.

To solve this problem, the surface of the heat roller 8 is coated with silicone and thus provided with weak adhesiveness. Thereby, the stain on the reverse side of the endless belt 2 is always removed.

The stain transferred onto the heat roller 8 is removed by a cleaning pad 55 put in pressure contact with the heat roller 8, and the surface of the heat roller 8 is refreshed.

The present embodiment has the following advantages.

Since the reverse side of the endless belt 2 is cleaned and the deformation of the endless belt due to contamination is prevented, the degradation in image quality is prevented.

Since the heat roller 8 cleans the reverse side of the endless belt 2, there is no need to newly provide a cleaner and the structure of the apparatus does not become complex.

Since the reverse side of the endless belt is cleaned by the rotating roller, the wear of the reverse side of the endless belt is prevented and the life of the endless belt is increased. Since the roller supporting the belt has the cleaning function for indirectly cleans the reverse side of the belt, the number of parts put in contact with the belt can be reduced to a minimum and the wear of the belt is prevented.

In the present embodiment, the heat roller is used as a cleaner. However, another roller supporting the endless belt 2, which is indispensable in the structure of the apparatus, may be used as cleaning roller, with the same advantages.

The heat roller 8 may be refreshed not only by the cleaning pad 55 but also by a blade, a roller or a web.

<Nineteenth Embodiment>

A nineteenth embodiment of the invention will now be described with reference to FIGS. 19A and 19B.

An endless belt 2 is a dielectric belt formed by coating a fluorine thin film with a thickness of 25 μm on the surface of a conductive polyimide layer with a thickness of 50 μm. The length of the endless belt 2 is about 830 mm. The dielectric belt 2 is passed between support rollers 110 and a heat roller 8 with tension. Each support roller 110 is a driven roller with a surface coated with fluorine, and the heat roller 8 has a surface coated with silicone rubber. A heat roller heater 81 is provided within the heat roller 8. The heat roller 8 is rotated by a motor (not shown) in a direction B, thereby moving the dielectric belt 2 passed on the heat roller 8 at a speed of 60 mm/s in the same direction. The dielectric belt 2 is surrounded by an ion cartridge (electrostatic image forming device) 5 for forming an electrostatic image forming device on the dielectric belt 2; a developing device 103 for adhering toner to the electrostatic latent image to form a toner image 9; a simultaneous transferring/fixing section T for simultaneously transferring and fixing the toner image 9 on a transfer medium 7 (which is a recording paper sheet conveyed in a direction P) with heat and pressure; a cleaning device 1 for removing a residual toner image 92, which has not been transferred on the transfer medium 7, from the dielectric belt 2; and an eraser 102 for eliminating a charge on the dielectric belt 2.

In the transferring/fixing section T, the transfer medium 7 is put in pressure contact, under a total pressure of 100 kgf, with the dielectric belt 2 by means of a pressing roller 6 driven by the dielectric belt 2. Thus, the toner image 9 melted by the heat of the heat roller 8 is transferred and fixed on the transfer medium 7.

Figure 19A:
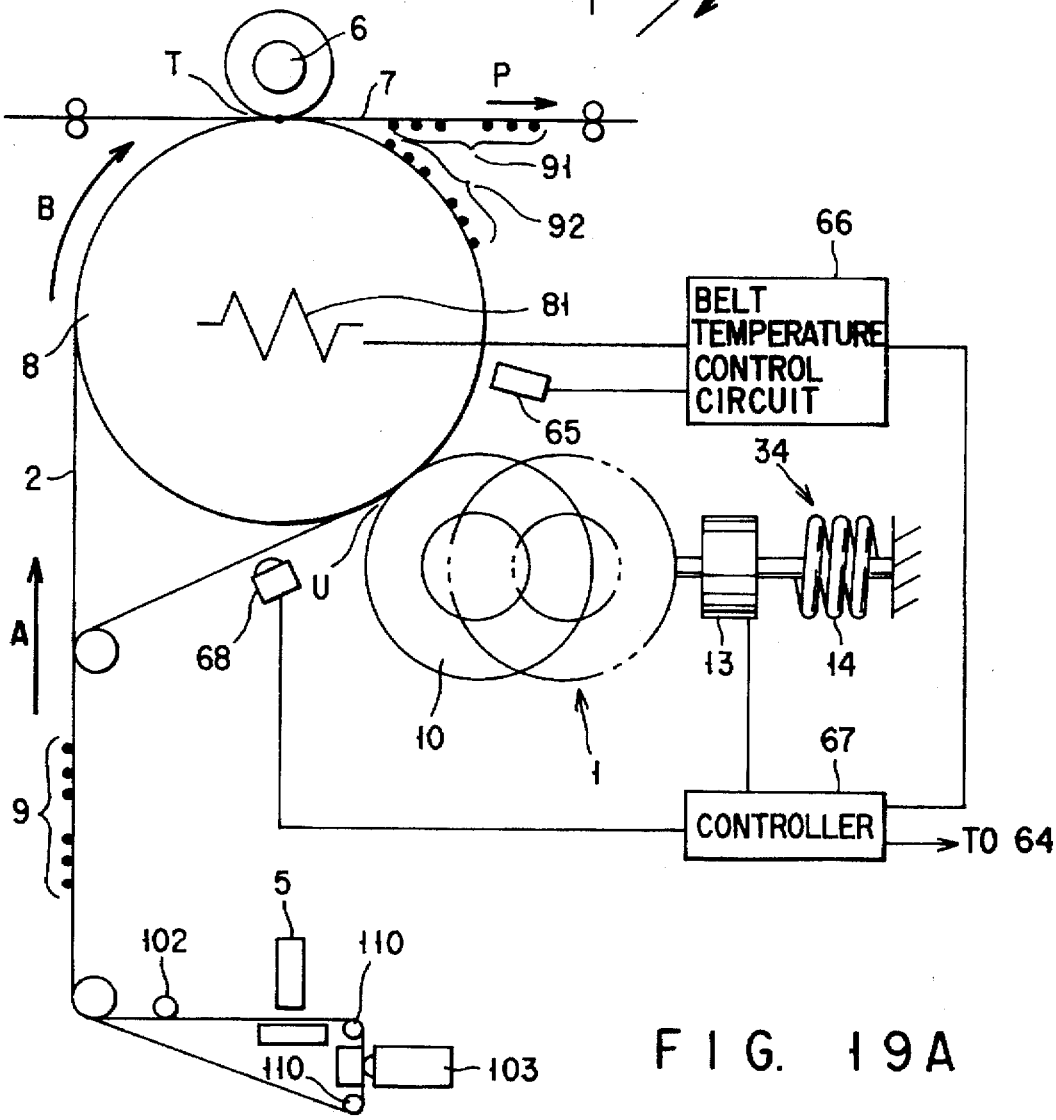
FIG. 19A shows an image forming apparatus according to a nineteenth embodiment of the invention.
Figure 19B:
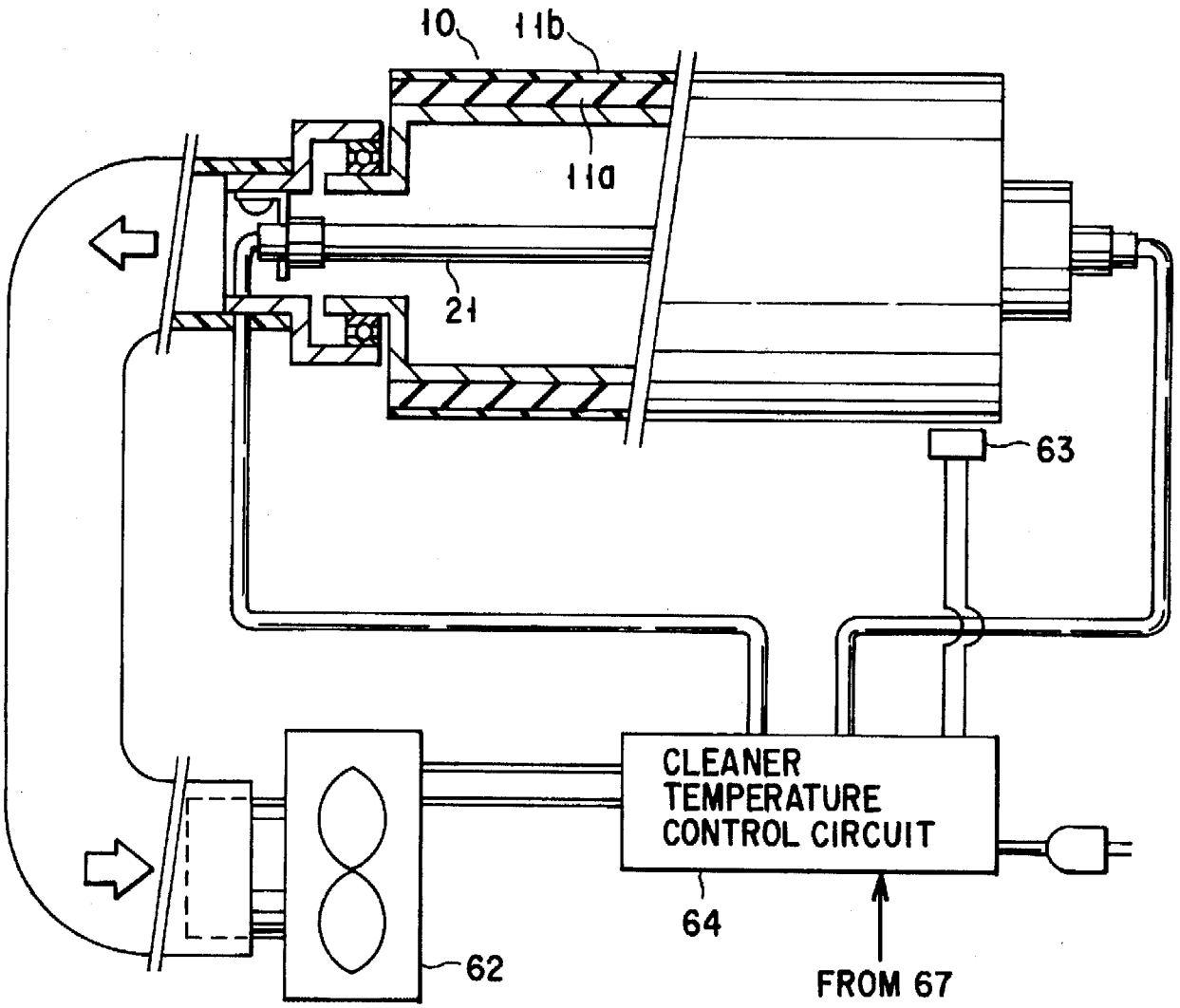
FIG. 19B shows a cleaning device in FIG. 19A.

FIG. 19B schematically shows the cleaning device 1 for removing the residual toner image 92. The cleaning roller 10 is coated with silicone rubber 11*a* with a rubber hardness of 40° and a thickness of 2 mm. A polyimide sheet 11*b* is wound around the silicone rubber 11*a*. The diameter of the cleaning roller 10 is about 40 mm. The cleaning device 1 comprises a halogen lamp 21 serving as heating means provided within the cleaning roller 10; a suction cooling device 62 serving as cooling means for sucking air from within the cleaning roller 10; a surface temperature sensor 63 for sensing the surface temperature of the cleaning roller 10; and a cleaner temperature control circuit 64 for controlling the operations of the halogen lamp 21 and suction cooling device 62 on the basis of information from the surface temperature sensor 63. The surface temperature of the cleaning roller 10 is set at a cleaning condition temperature (about 100°).

As is shown in FIG. 19A, the cleaning roller 10 is put in contact with the dielectric belt 2 under a total pressure of about 4 kgf and driven by the dielectric belt 2 at a cleaning position U near the end of a contact region between the dielectric belt 2 and heat roller 8. The surface temperature of the dielectric belt 2 at the cleaning position U is sensed by the temperature sensor 65. On the basis of the sensed information, the belt temperature control circuit 66 controls the turning-on/off of the heat roller 81, and the surface temperature of the dielectric belt 2 at the cleaning position U is kept at a cleaning condition temperature (about 160° C.).

In this case, since the thickness of the dielectric belt 2 is 75 μm and small, the surface temperature of the dielectric belt 2 at the transferring/fixing section T is equal to the cleaning condition temperature (about 160° C.), and the transferring/fixing operation is finely performed.

The operation of this embodiment will now be described.

When the surface temperature of the cleaning roller 10 is lower than the cleaning condition temperature for achieving a good cleaning effect, for example, at the time of start-up of the apparatus, the cleaner temperature control circuit 64 turns on the halogen lamp 21 on the basis of the temperature information from the surface temperature sensor 63, thereby heating the cleaning roller 10 up to the cleaning condition temperature in a short time.

Since the cleaning condition temperature (about 100° C.) of the cleaning roller 10 is lower than the cleaning condition temperature (about 160° C.) of the dielectric belt 2, the surface temperature of the cleaning roller 10 becomes higher than the cleaning condition temperature (about 100° C.) due to continuous use, resulting in a lower cleaning performance. Thus, the temperature of the cleaning roller 10 is always measured by the temperature sensor 63, and if the surface temperature of the cleaning roller 10 has risen, the cleaner temperature control circuit 64 activates the suction cooling device 62, thereby cooling the cleaning roller 10, keeping the temperature of the cleaning roller 10 at the cleaning condition temperature (about 100° C.), and maintaining the cleaning performance.

Accordingly, the present embodiment has the following advantages.

Since the cleaning position U is set on the heat roller 8 for performing the transferring/fixing operation, the temperature of the dielectric belt 2 at the cleaning position U can be controlled without providing a heating source other than the heating force for the transferring/fixing operation.

Since the halogen lamp 21 is used as heating source for heating the cleaning roller 10 and the suction cooling device is used as cooling source, the temperature control is effected with simple apparatus construction.

Needless to say, the structure of this embodiment can be modified variously.

For example, the cooling source or heating source may be replaced with a heat pipe.

A heating source other than the heat roller 8 may be provided as heating means for heating the dielectric belt 2 at the cleaning position U.

Figure 19C:
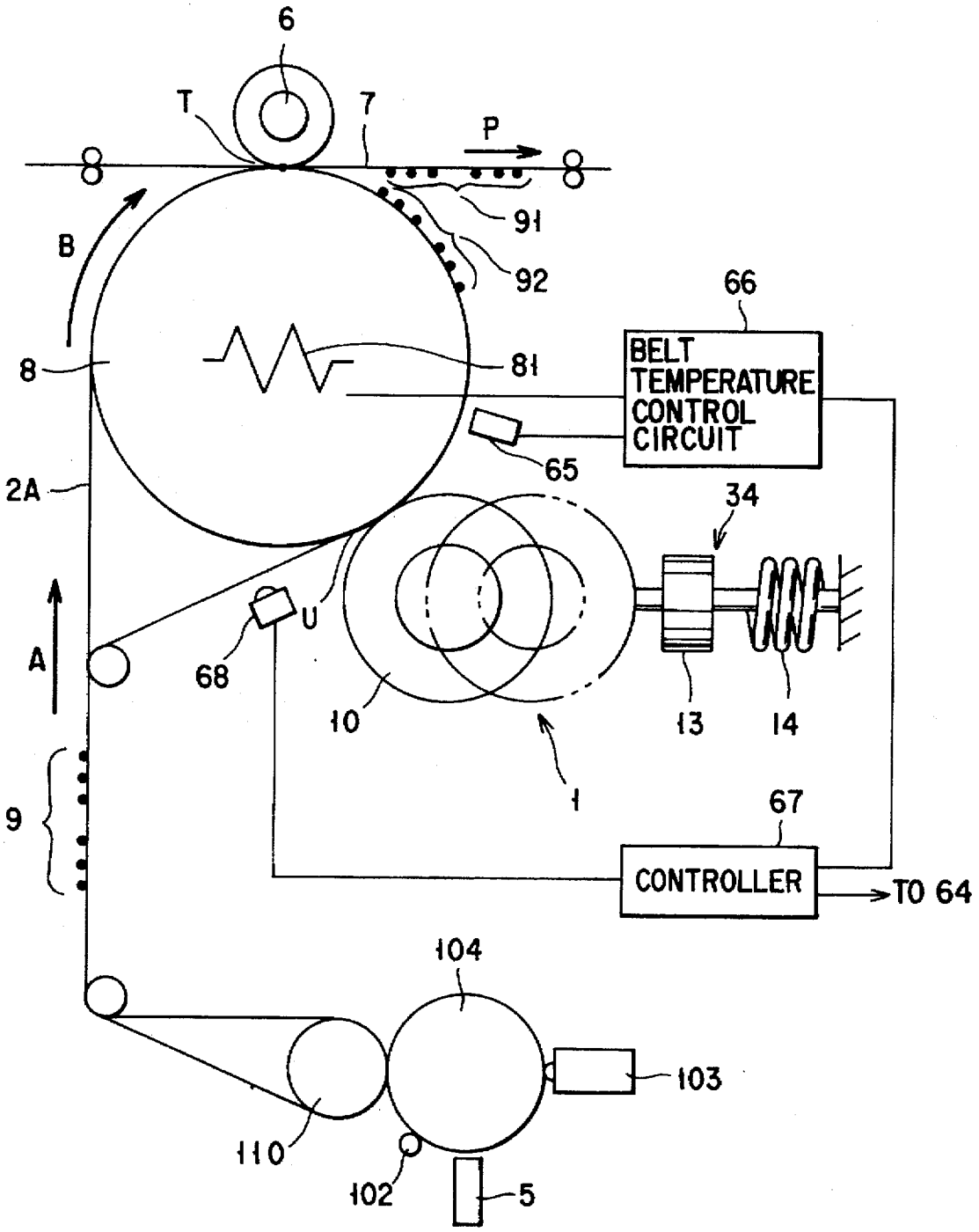
FIG. 19C shows a modification of the image forming apparatus according to the nineteenth embodiment of the invention.

The cleaning device may be used for cleaning an intermediate transfer belt 2A in an apparatus wherein a toner image is formed on an image carrying drum 104, the toner image is temporarily transferred onto the intermediate transfer belt 2A, and then the toner image is transferred and fixed on the transfer medium 7, as shown in FIG. 19C.

<EXAMPLE>

An actual example of the nineteenth embodiment of the invention will now be described with reference to FIGS. 19D and 19E.

The structure of the apparatus in this example is the same as that of the embodiment. However, a low-melting-point toner is used in the developing device 103 in this example.

The low-melting-point toner is a magnetic one-component toner containing styrene acryl as a main portion and 40% of magnetic powder. FIG. 19D shows temperature/viscosity characteristics of this toner.

When this toner was used to form an image with printing density of 5% and perform simultaneous transferring/fixing, the cleaning performance with the combination of the surface temperature of the dielectric belt 2 and the surface temperature of the cleaning roller 10 at the cleaning position U was studied. The result of the study is shown in FIG. 19E.

Figure 19D:
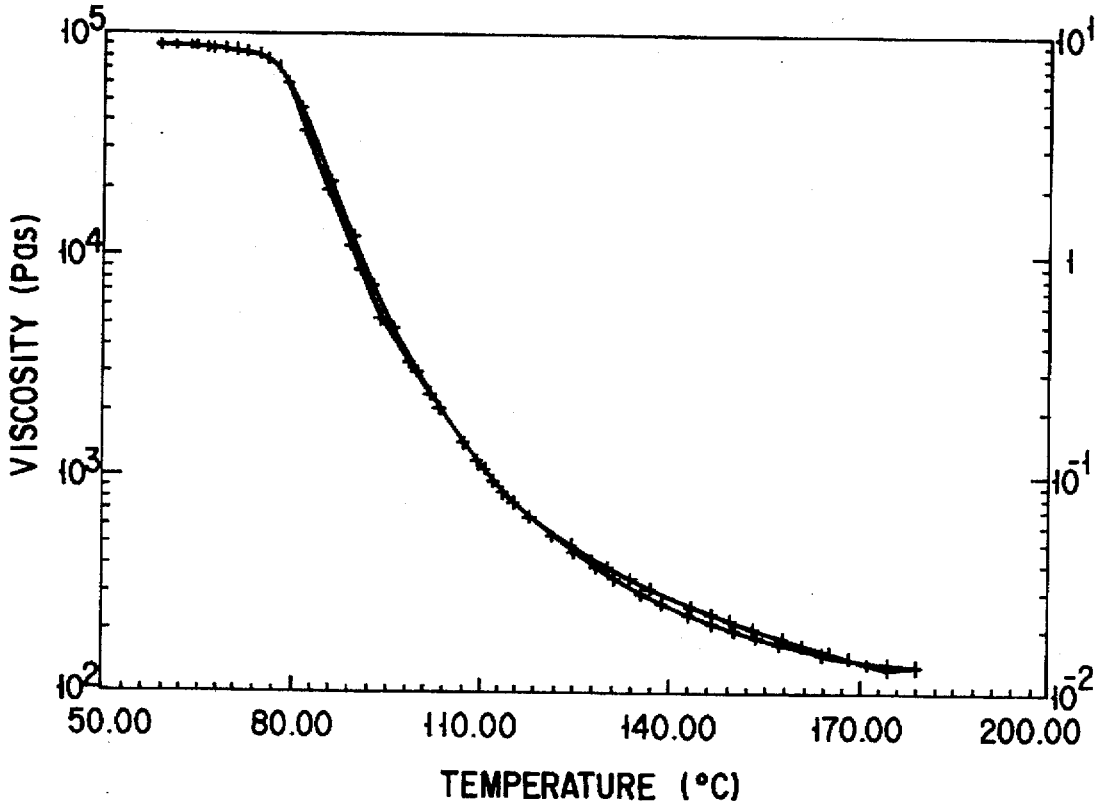
FIG. 19D is a graph showing temperature characteristics in relation to viscosity of toner in the nineteenth embodiment.
Figure 19E:
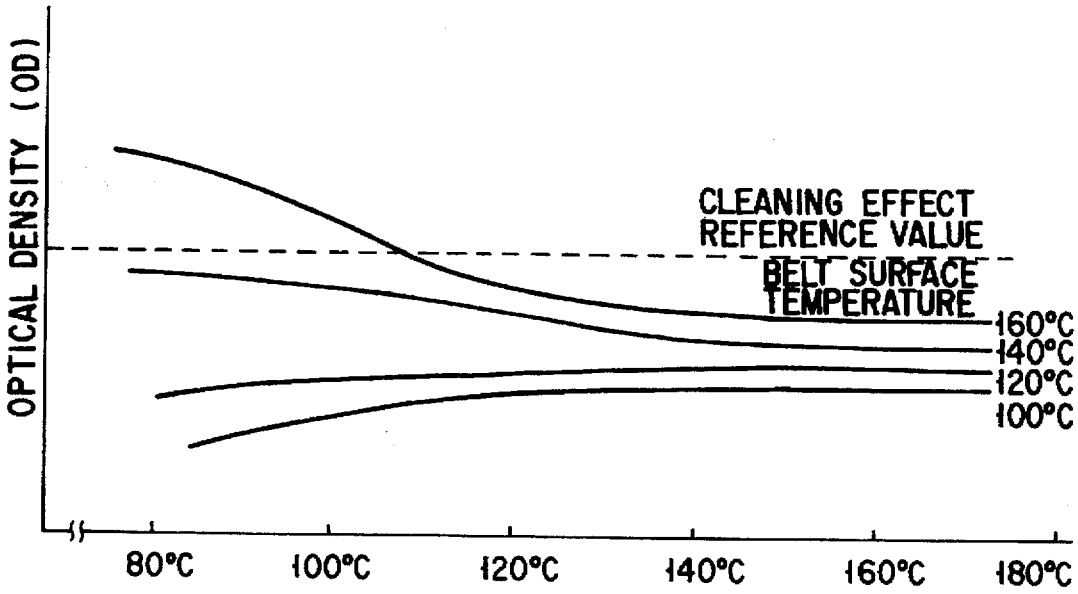
FIG. 19E is a graph showing cleaning effects under various conditions in the nineteenth embodiment.

In the graph of FIG. 19E, the abscissa indicates the surface temperature of the cleaning roller 10 and the ordinate indicates an optical density of the stain of the toner image on the cleaned dielectric belt 2, which was removed by a mending tape (manufactured by SCOTCH Co.) and measured by an optical density meter.

A reference value (optical density) of the cleaning effect is such an optical density that an after-image of a preceding image does not appear on a current image due to insufficient cleaning.

According to the obtained result, the surface temperature range of the cleaning roller 10 for good cleaning was between 100° C. and 80° C. when the surface temperature of the dielectric belt 2 was 160°.

The result was considered in combination of the graph of FIG. 19D, and it was found that good cleaning effect was obtained when the toner met the following condition.

The viscosity of the toner one the dielectric belt 2 is $2\times10^2$ Pas or above, while the viscosity of the toner on the cleaning roller 10 is $5\times10^4$ Pas or below and $2\times10^3$ Pas or above.

<Twentieth Embodiment>

An image forming apparatus according to a twentieth embodiment of the invention will now be described with reference to FIG. 20. The structure of the apparatus of this embodiment is the same as that of the nineteenth embodiment (FIGS. 19A to 19C).

The image forming process in this embodiment is as follows. In FIG. 19A, a latent image is formed on the dielectric belt 2 by the ion cartridge 5. Toner is adhered to the formed latent image and the latent image is made visible. Then, the visible toner image is transferred to a point between the heat roller 8 and pressing roller 6 along with the transfer medium 7. Furthermore, the dielectric belt 2 with the toner image 9 is heated on the reverse side thereof by the heat roller 8, and the toner image 9 on the dielectric belt 2 is softened. The toner image 9 is thermally transferred onto the transfer medium 7 and at the same time the toner image 9 is pressed by the pressing roller 6 with use of a pressing mechanism (not shown) and fixed on the transfer medium 7. Then, the transfer medium 7 and the dielectric belt 2 are separated by a separating device (not shown), and the transfer medium 7 is discharged. On the other hand, the residual toner 92 is removed from the dielectric belt 2 by means of the cleaning device 1.

Figure 20:
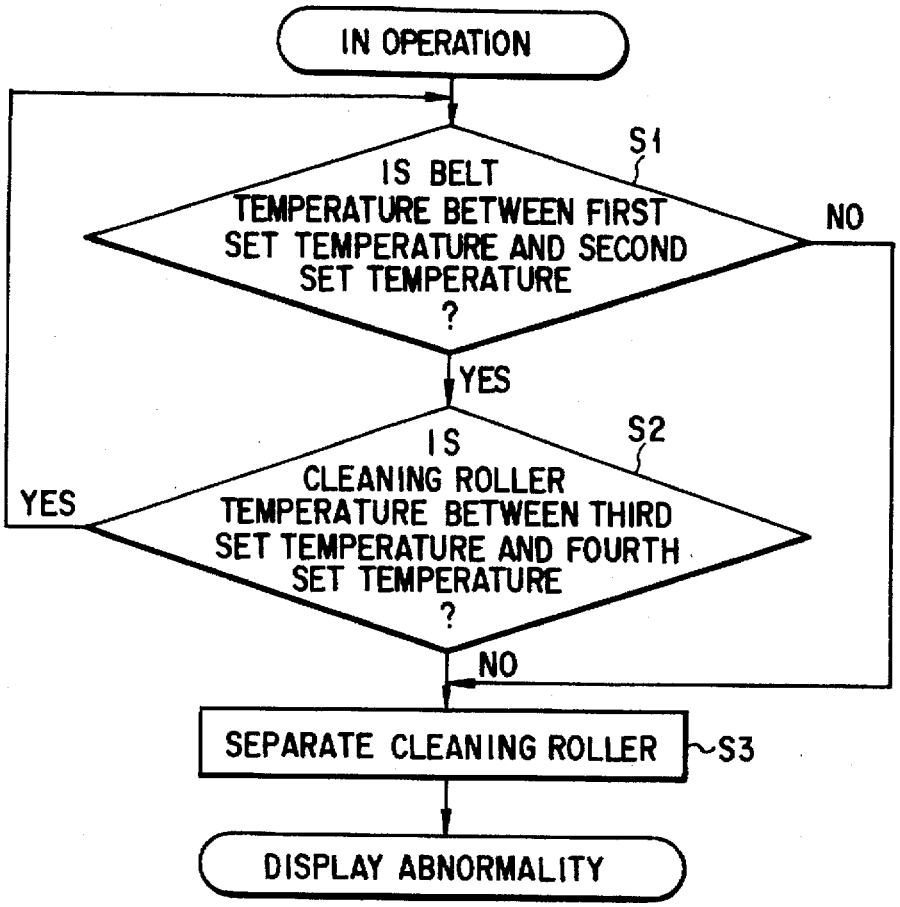
FIG. 20 is a flow chart illustrating the operation of an image forming apparatus according to a twentieth embodiment of the invention.

If any abnormality occurs in an image forming process and a temperature distribution in the thickness direction of toner is adversely affected at the cleaning position U, the controller 67 performs the following control operations, as illustrated in the flow chart of FIG. 20.

If the temperature of the dielectric belt 2 at the cleaning position U is not between a first set temperature and a second set temperature ("NO" in step S1) or if the temperature of the cleaning roller 10 is not between a third set temperature and a fourth set temperature ("NO" in step S2), the cleaning roller 10 is separated from the dielectric belt 2 (step S3) and the abnormality is displayed on a display section of an operation panel (not shown).

The first set temperature is a lowest temperature in a temperature range of the endless belt within which good cleaning can be performed. The second set temperature is a highest temperature in the temperature range of the endless belt within which good cleaning can be performed. The third set temperature is a lowest temperature in a temperature range of the cleaning roller within which good cleaning can be performed. The fourth set temperature is a highest temperature in the temperature range of the cleaning roller within which good cleaning can be performed. For example, in the case of a belt having a surface coated with polyimide and toner, which may be used in an embodiment, a good cleaning operation can be performed when the surface temperature of the dielectric belt 2 is in a range approximately between 150° C. and 160° C. and when the surface temperature of the cleaning roller 10 is in a range approximately between 80° C. and 100° C. Specifically, in this case, the first set temperature is 150° C., the second set temperature is 160° C., the third set temperature is 80° C., and the fourth set temperature is 100° C. However, since physical properties vary depending on the material of the dielectric belt 2 and toner, the first to fourth temperatures are not limited to the above.

The operation of this embodiment will now be described.

In a cleaning device wherein toner is thermally softened and removed, a good cleaning effect cannot be obtained unless a temperature distribution proper to toner is obtained at the cleaning position U. Thus, in this embodiment, if a temperature distribution proper to toner is not obtained at the cleaning position U due to an abnormal operation, etc., the cleaning roller 10 is separated from the dielectric belt 2 by the temperature sensor 65 of the dielectric belt 2, the temperature sensing means 63 of the cleaning roller 10 and the contacting/separating mechanism 34 for contacting/separating the cleaning roller 10 with/from the dielectric belt 2. It is thus possible to prevent toner from being transferred from the cleaning roller 10 to the dielectric belt 2 as reverse offset toner, or to prevent cooled and solidified toner on the cleaning roller 10 from being broken on the dielectric belt 10.

Therefore, the present embodiment has the following advantage.

The surface temperatures of the dielectric belt and cleaning roller at the cleaning position U are sensed, and the cleaning roller is contacted/separated with/from the dielectric belt. Thereby, the dielectric belt is prevented from being stained or damaged by unnecessary toner.

<Twenty-first Embodiment>

An image forming device according to a twenty-first embodiment of the invention will now be described with reference to FIG. 21.

The apparatus construction and image forming process of this embodiment are the same as those of the twentieth embodiment. In this embodiment, the controller 67 has power supply state recognizing means for recognizing the state of power supply to the apparatus.

Figure 21:
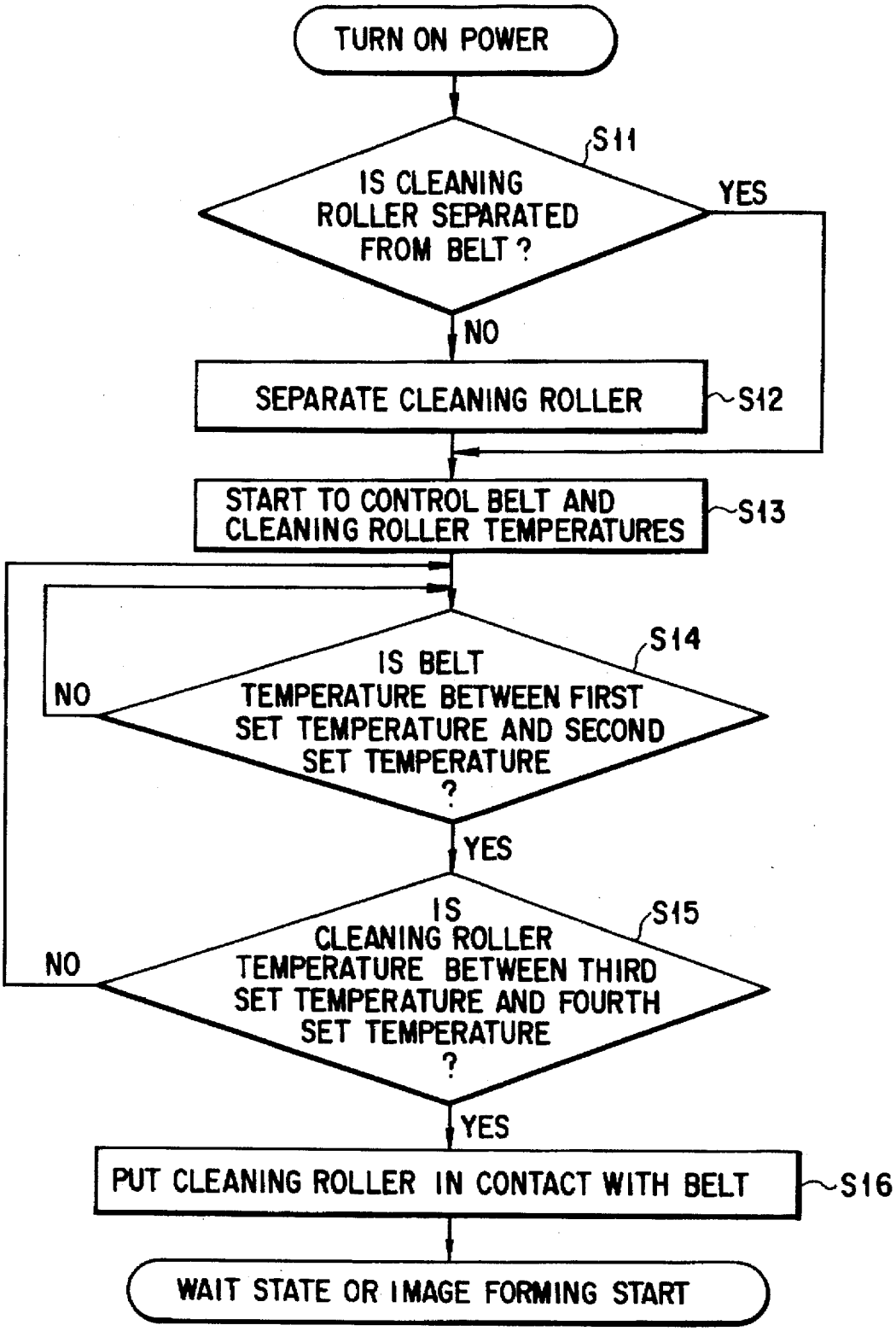
FIG. 21 is a flow chart illustrating the operation of an image forming apparatus according to a twenty-first embodiment of the invention.

If the turn-on of power to the apparatus is recognized, the controller 67 performs the following operations, as illustrated in the flow chart of FIG. 21.

It is determined whether the cleaning roller 10 is separated from the dielectric belt 2 (step S11). If the cleaning roller 10 is not separated, the roller 10 is separated (step S12).

The surface temperature of the dielectric belt 2 at the cleaning position U is set between the first set temperature and second set temperature (steps S13 and S14), and the surface temperature of the cleaning roller 10 is set between the third set temperature and fourth set temperature (steps S13 and S15).

After it is confirmed that the surface temperatures of the dielectric belt 2 and cleaning roller 10 at the cleaning position U are set in the aforementioned temperature ranges, the cleaning roller 10 is put in contact with the dielectric belt 2 (step S16) and the apparatus is set in the image formation wait state. Upon receiving an image formation command, the image formation is started.

The operation of this embodiment will now be described.

In a cleaning device wherein toner is thermally softened and removed, a good cleaning effect cannot be obtained unless a temperature distribution proper to toner is obtained at the cleaning position U. When power is turned on, both dielectric belt 2 and cleaning roller 10 are at normal temperature in the normal condition. At this time, a toner layer deposited on the cleaning roller 10 is cooled and solidified. If the cleaning roller 10 is put in pressure contact with and driven by the dielectric belt 2 in this state, the toner layer is broken and dispersed and may cause mechanical damage to the surface of the dielectric belt 2, the developing device 103 situated near the dielectric belt 2, etc. In this embodiment, the cleaning roller 10 is separated from the dielectric belt 2 by means of the contacting/separating mechanism 34, and the dielectric belt 2 is heated by the heat roller heater 81 and the cleaning roller 10 is heated by the halogen lamp 21. When the dielectric belt 2 and cleaning roller 10 have been heated until a temperature distribution proper to toner is obtained at the cleaning position U, the cleaning roller 10 is brought into contact with the dielectric belt 2. Thereby, the cooled and solidified toner on the cleaning roller 10 is prevented from being broken and dispersed on the dielectric belt 2.

Accordingly, this embodiment has the following advantage.

When power to the apparatus is turned on, the dielectric belt 2 and cleaning roller 10 are individually heated and the surface temperatures of the dielectric belt 2 and cleaning roller 10 are sensed. When the dielectric belt 2 and cleaning roller 10 have been heated until a temperature distribution proper to toner is obtained at the cleaning position U, the cleaning roller 10 is brought into contact with the dielectric belt 2. Thereby, the dielectric belt 2 or the peripheral device thereof is prevented from being stained with toner or mechanically damaged.

<Twenty-second Embodiment>

An image forming apparatus according to a twenty-second embodiment will now be described with reference to FIG. 22.

The apparatus construction and image forming process of this embodiment are the same as those of the twentieth embodiment. In this embodiment, the controller 67 includes set time input means for setting a predetermined time, means for counting time, and set time comparing means for comparing the input set time and the counted time.

Figure 22:
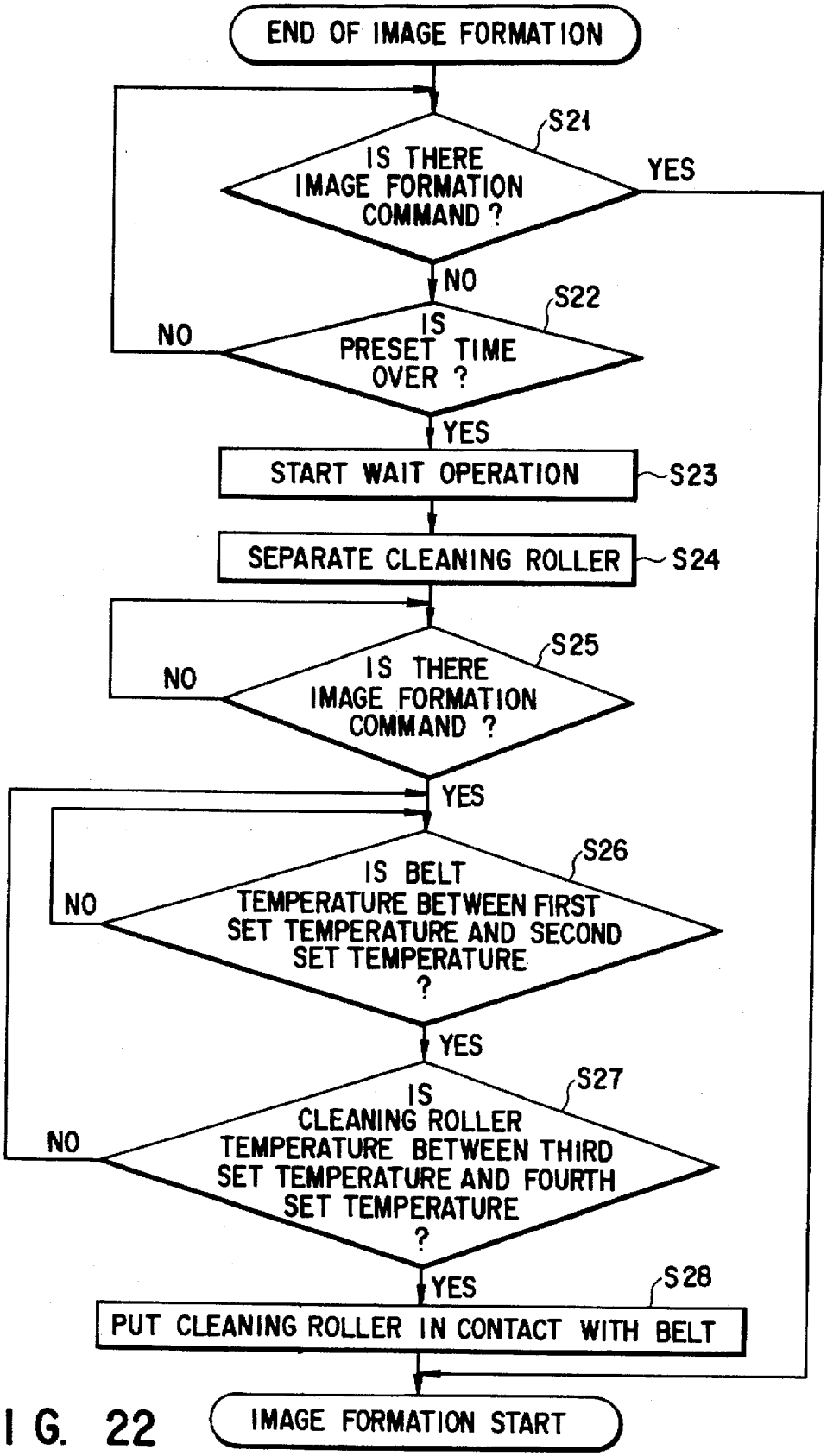
FIG. 22 is a flow chart illustrating the operation of an image forming apparatus according to a twenty-second embodiment of the invention.

When an image forming operation is completed, the controller 67 performs the following operations, as illustrated in the flow chart of FIG. 22.

After the image forming operation is completed, it is monitored whether or not an image formation command has been input (step S21) and a preset time is measured (step S22). If the image formation command is not input within the preset time, the apparatus enters the image formation wait state (step S23).

In the wait state, the cleaning roller 10 is separated from the dielectric belt 2 (step S24) and the confirmation as to whether the image formation command is input is continued (step S25).

If the controller 67 has confirmed the input of the image formation command in this state, the heat roller 8 is heated and the surface temperature of the cleaning roller 10 is restored in the temperature range between the third set temperature and fourth set temperature within which the cleaning effect is exhibited, and it is confirmed that the temperature of the dielectric belt 2 at the cleaning position U is set in the temperature range between the first set temperature and second set temperature (step S26). In addition, it is confirmed that the temperature of the cleaning roller 10 is set in the temperature range between the third set temperature and fourth set temperature (step S27). Then, the cleaning roller 10 is brought into contact with the dielectric belt 2 (step S28) and the image formation is started.

If the image formation command is input within the preset time in step S21, the image formation is immediately started.

The operation of the present embodiment will now be described.

In a cleaning device wherein toner is thermally softened and removed, a good cleaning effect cannot be obtained unless a temperature distribution proper to toner is obtained at the cleaning position U. In the image formation wait state, it is possible to lower the temperature of the dielectric belt 2 in order to save power or protect the dielectric belt 2 from thermal stress. If the cleaning roller 10 is put in pressure contact with and driven by the dielectric belt 2 in this state, adhesive force varies between the dielectric belt 2 and the toner, in the thickness direction of the toner, and between the toner and the cleaning roller 10. As a result, unnecessary toner is reversely adhered from the cleaning roller 10 to the dielectric belt 2, and a mechanical damage is caused to the surface of the dielectric belt 2, the developing device 103 situated near the dielectric belt 2, etc. In the present embodiment, the cleaning roller 10 is separated from the dielectric belt 2 in the image formation wait state and, when the image formation command is input, the dielectric belt 2 is heated by the heat roller heater 81 and the cleaning roller 10 is heated by the halogen lamp 21. When the dielectric belt 2 and cleaning roller 10 have been heated until a temperature distribution proper to toner is obtained at the cleaning position U, the cleaning roller 10 is brought into contact with the dielectric belt 2. Thereby, the toner deposited on the cleaning roller 10 is prevented from being reversely adhered to the dielectric belt 2.

Accordingly, the present embodiment has the following advantage.

In the case of the apparatus wherein power is saved by lowering the temperature of the dielectric belt 2 in the image formation wait state, the cleaning roller 10 is separated from the dielectric belt 2. In the image formation mode, the cleaning roller 10 is brought into contact with the dielectric belt 2 after the temperature distribution proper to toner is obtained at the cleaning position U. Thereby, the dielectric belt 2 or the peripheral device thereof is prevented from being stained with toner or mechanically damaged.

<Twenty-third Embodiment>

An image forming apparatus according to a twenty-third embodiment will now be described with reference to FIG. 23.

The apparatus construction and image forming process of this embodiment are the same as those of the twentieth embodiment. In this embodiment, the controller 67 includes set time input means for setting a predetermined time, means for counting time, and set time comparing means for comparing the input set time and the counted time.

Figure 23:
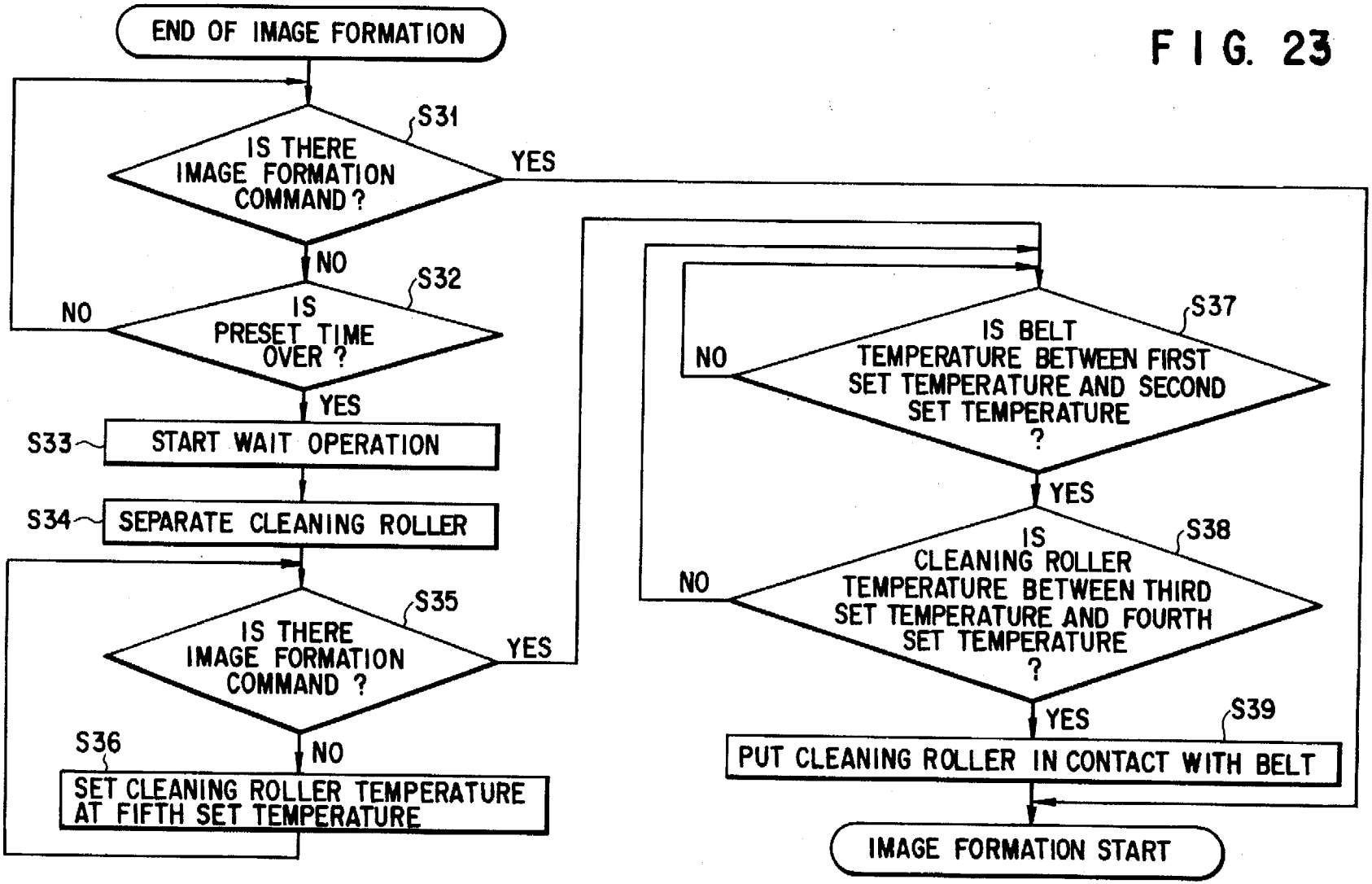
FIG. 23 is a flow chart illustrating the operation of an image forming apparatus according to a twenty-third embodiment of the invention.

When an image forming operation is completed, the controller 67 performs the following operations, as illustrated in the flow chart of FIG. 23.

After the image forming operation is completed, it is monitored whether or not an image formation command has been input (step S31) and a preset time is measured (step S32). If the image formation command is not input within the preset time, the apparatus enters the image formation wait state (step S33).

In the wait state, the cleaning roller 10 is separated from the dielectric belt 2 (step S34), the temperature of the cleaning roller 10 is set at a fifth set temperature (step S36), and the confirmation as to whether the image formation command is input is continued (step S35). The fifth set temperature is, for example, a temperature between normal temperature and the third set temperature.

If the controller 67 has confirmed the input of the image formation command in this state (step S35), the temperature of the cleaning roller 10 is restored in the temperature range between the third set temperature and fourth set temperature within which the cleaning effect is exhibited, and it is confirmed that the temperature of the dielectric belt 2 at the cleaning position U is set in the temperature range between the first set temperature and second set temperature (step S37). In addition, it is confirmed that the temperature of the cleaning roller 10 is set in the temperature range between the third set temperature and fourth set temperature (step S38). Then, the cleaning roller 10 is brought into contact with the dielectric belt 2 (step S39) and the image formation is started.

If the image formation command is input within the preset time in step S31, the image formation is immediately started.

The operation of this embodiment will now be described.

In this embodiment, while the cleaning roller 10 is being separated from the dielectric belt 2, the temperature of the cleaning roller 10 is set at a value lower than the temperature in the cleaning mode. Thereby, power is further saved.

At the same time, in the wait state, the temperature of the cleaning roller 10 is set at a lowest level in the temperature range in which the cleaning effect is exhibited. Thereby, the start-up time is shortened when the image formation command is input.

Accordingly, this embodiment has the following advantages.

In the case of the apparatus wherein power is saved in the image formation wait time by lowering the temperature of the dielectric belt 2, the dielectric belt 2 is separated from the cleaning roller 10. In the image formation mode, the cleaning roller 10 is brought into contact with the dielectric belt 2 after the temperature distribution proper to toner is obtained at the cleaning position U. Thereby, the dielectric belt 2 or the peripheral device thereof is prevented from being stained with toner or mechanically damaged.

The temperature of the cleaning roller 10 separated from the dielectric belt 2 is set at a value lower than the temperature in the cleaning mode. Thereby, power is further saved.

Moreover, in the wait state, the temperature of the cleaning roller 10 is set at a lowest level in the temperature range in which the cleaning effect is exhibited. Thereby, an increase in start-up time is prevented when the image formation command is input.

<Twenty-fourth Embodiment>

An image forming apparatus according to a twenty-fourth embodiment of the invention will now be described with reference to FIG. 24.

The apparatus construction and image forming process of this embodiment are the same as those of the twentieth embodiment. In this embodiment, the controller 67 has means for detecting a jam in the conveying system of the transfer medium 7.

Figure 24:
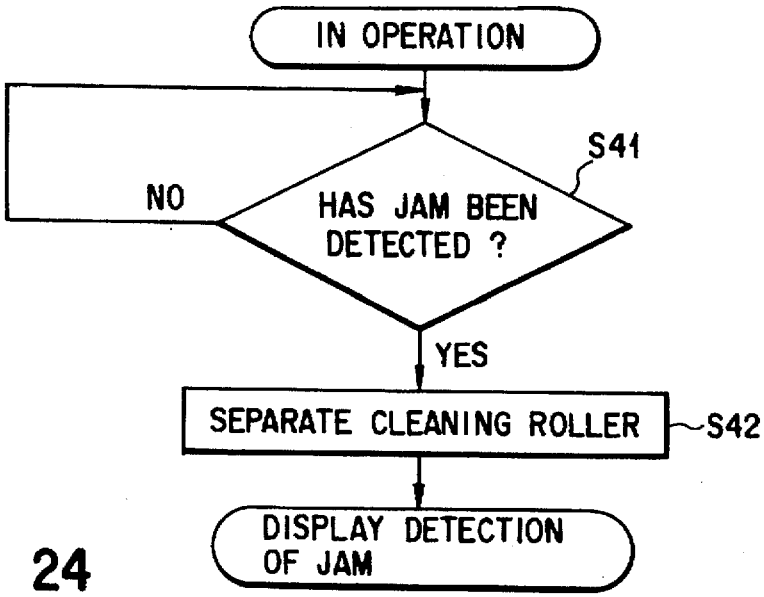
FIG. 24 is a flow chart illustrating the operation of an image forming apparatus according to a twenty-fourth embodiment of the invention.

If a jam occurs in the conveying system of the transfer medium 7 in the ordinary image forming operation, the controller 67 performs the following operations, as illustrated in the flow chart of FIG. 24.

If the controller 67 confirms the jam ("YES" in step S41), the cleaning roller 10 is separated from the dielectric belt 2 (step S42) and then the detection of jam is displayed on a display section of an operation panel (not shown).

The operation of this embodiment will now be described.

When the jam has been detected, if the cleaning roller 10 is kept in pressure contact with the dielectric belt 2 while the temperature at the cleaning position U is lowering, adhesive force varies between the dielectric belt 2 and the toner, in the thickness direction of the toner, and between the toner and the cleaning roller 10. As a result, unnecessary toner is reversely adhered from the cleaning roller 10 to the dielectric belt 2 at the time of restart of the apparatus, and a mechanical damage is caused to the surface of the dielectric belt 2, the developing device 103 situated near the dielectric belt 2, etc. Thus, in the present embodiment, when the jam has been detected, the cleaning roller 10 is separated from the dielectric belt 2 by the contacting/separating mechanism 34. Thereby, the toner deposited on the cleaning roller 10 is prevented from being reversely transferred onto the dielectric belt 2.

Accordingly, the present embodiment has the following advantage.

Since the cleaning roller 10 is separated from the dielectric belt 2 when the jam has been detected, the dielectric belt 2 or the peripheral device thereof is prevented from being stained with toner or mechanically damaged.

<Twenty-fifth Embodiment>

An image forming apparatus according to a twenty-fifth embodiment of the invention will now be described with reference to FIG. 25.

The apparatus construction and image forming process of this embodiment are the same as those of the twentieth embodiment. In this embodiment, the controller 67 has means for detecting a jam in the conveying system of the transfer medium 7.

Figure 25:
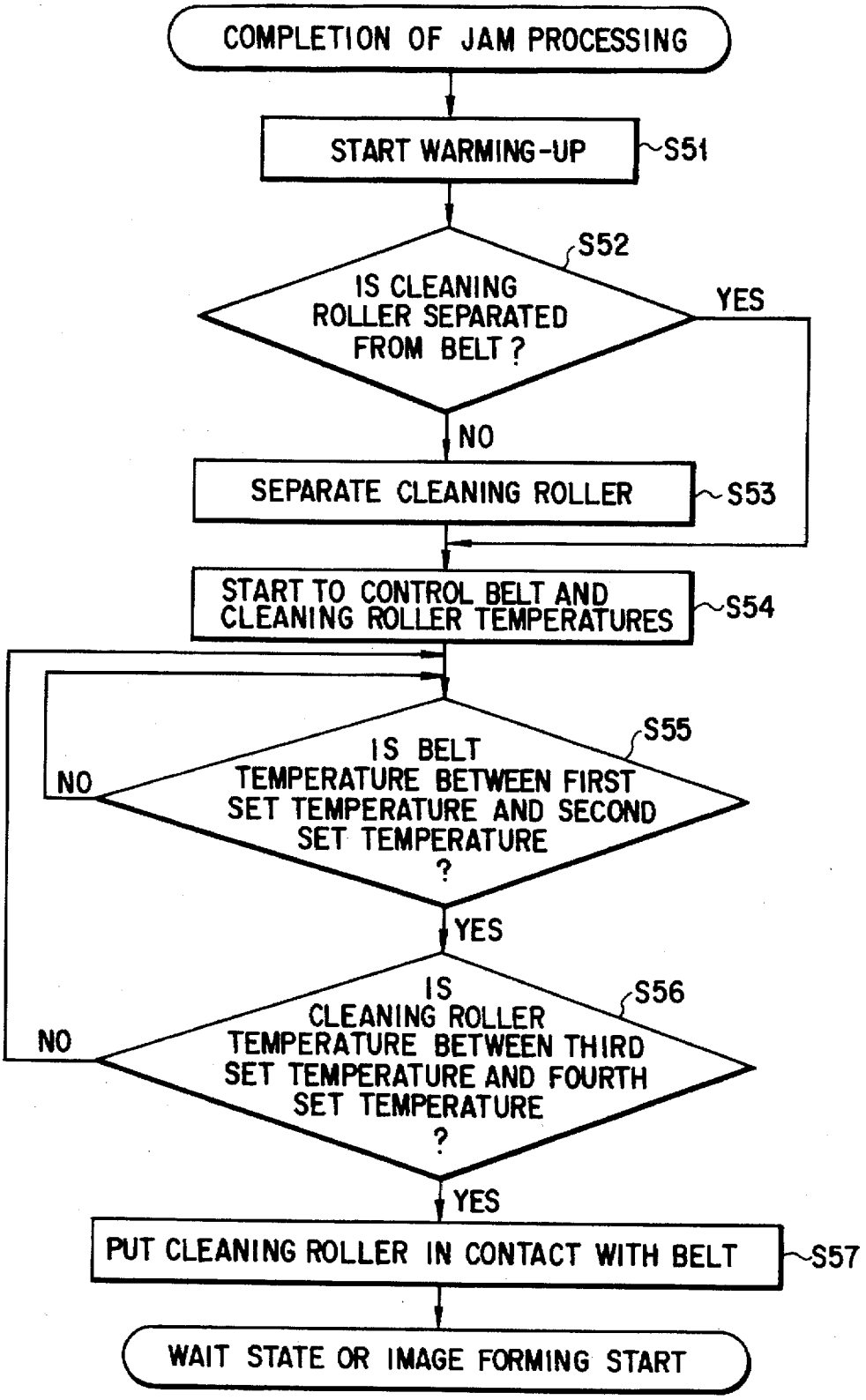
FIG. 25 is a flow chart illustrating the operation of an image forming apparatus according to a twenty-fifth embodiment of the invention.

If a jam occurs in the convey system of the transfer medium 7 and the Jam process is completed, the controller 67 performs the following operations, as illustrated in the flow chart of FIG. 25.

At first, the warming-up begins (step S51) and it is determined whether the cleaning roller 10 is separated from the dielectric belt 2 (step S52). If the cleaning roller 10 is not separated from the dielectric belt 2 ("NO" in step S52), the cleaning roller 10 is separated (step S53).

The surface temperature of the dielectric belt 2 at the cleaning position U is set between the first set temperature and second set temperature (steps S54 and S55), and the surface temperature of the cleaning roller 10 is set between the third set temperature and fourth set temperature (steps S54 and S56).

After it is confirmed that the surface temperatures of the dielectric belt 2 and cleaning roller 10 at the cleaning position U are set in the aforementioned temperature ranges, the cleaning roller 10 is put in contact with the dielectric belt 2 (step S57) and the apparatus is set in the image formation wait state. Upon receiving an image formation command, the image formation is started.

The operation of this embodiment will now be described.

When the jam has been detected, if the cleaning roller 10 is kept in pressure contact with the dielectric belt 2 while the temperature at the cleaning position U is lowering, adhesive force varies between the dielectric belt 2 and the toner, in the thickness direction of the toner, and between the toner and the cleaning roller 10. As a result, unnecessary toner is reversely adhered from the cleaning roller 10 to the dielectric belt 2 at the time of restart of the apparatus, and a mechanical damage is caused to the surface of the dielectric belt 2, the developing device 103 situated near the dielectric belt 2, etc. Thus, in the present embodiment, when the jam has been detected, the cleaning roller 10 is separated from the dielectric belt 2 by the contacting/separating mechanism 34. When the operation of the apparatus is restarted, the dielectric belt 2 is heated by the heat roller heater 81 and the cleaning roller 10 is heated by the halogen lamp 21. When the dielectric belt 2 and cleaning roller 10 have been heated until a temperature distribution proper to toner is obtained at the cleaning position U, the cleaning roller 10 is put in contact with the dielectric belt 2. Thereby, the toner deposited on the cleaning roller 10 is prevented from being reversely transferred onto the dielectric belt 2.

Accordingly, the present embodiment has the following advantage.

When the jam has been detected, the cleaning roller 10 is separated from the dielectric belt 2. When the operation of the apparatus is restarted, the cleaning roller 10 is put in contact with the dielectric belt 2 after the temperature distribution proper to toner is obtained at the cleaning position U. Thus, the dielectric belt 2 or the peripheral device thereof is prevented from being stained with toner or mechanically damaged.

<Twenty-sixth Embodiment>

An image forming apparatus according to a twenty-sixty embodiment of the invention will now be described with reference to FIGS. 26A and 26B.

The apparatus construction and image forming process of this embodiment are the same as those of the twentieth embodiment. In this embodiment, the controller 67 has means for detecting a jam in the conveying system of the transfer medium 7.

Figure 26A:
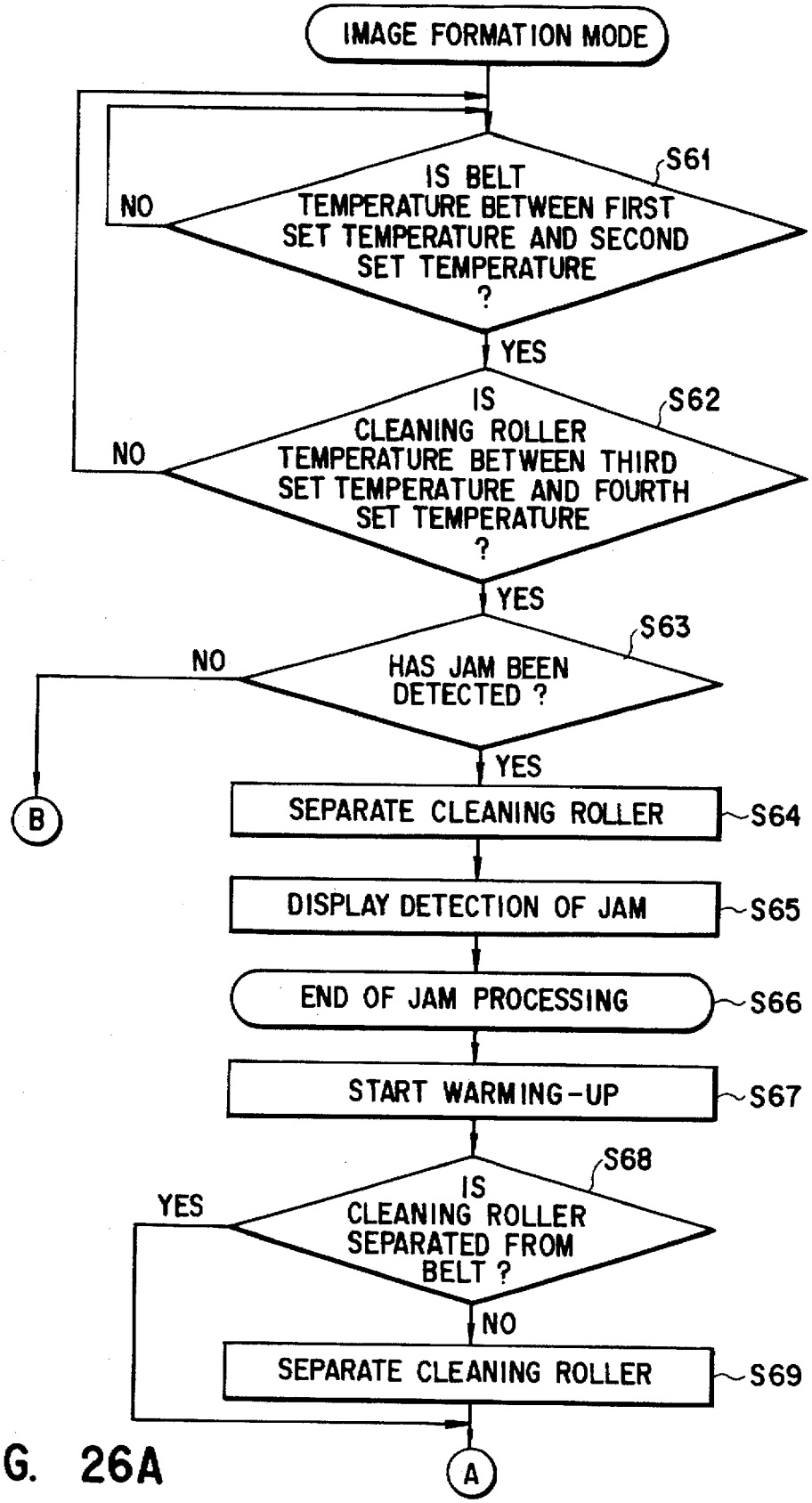
FIGS. 26A and 26B are flow charts illustrating the operation of an image forming apparatus according to a twenty-sixth embodiment of the invention.
Figure 26B:
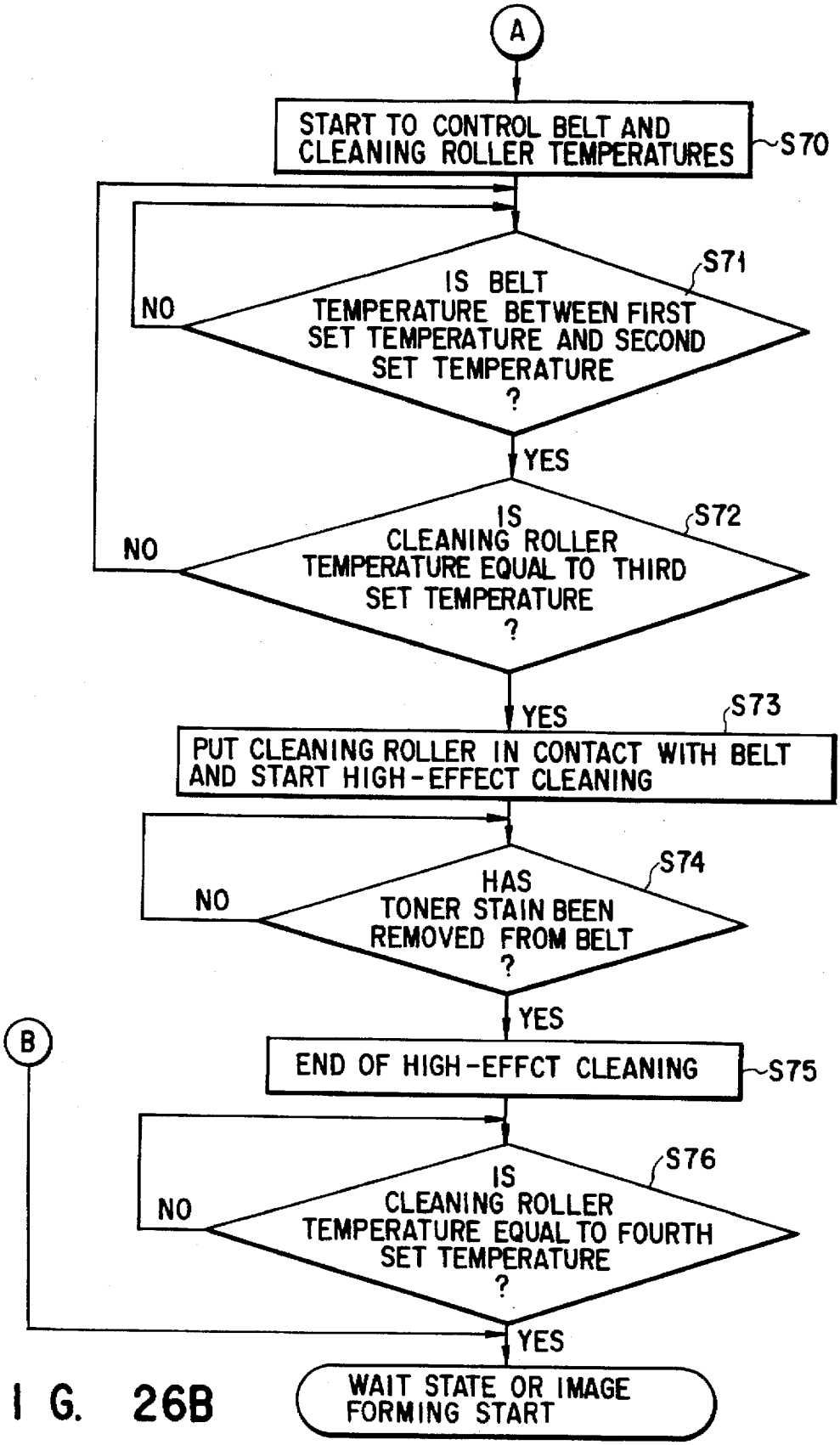
Figure 27A:
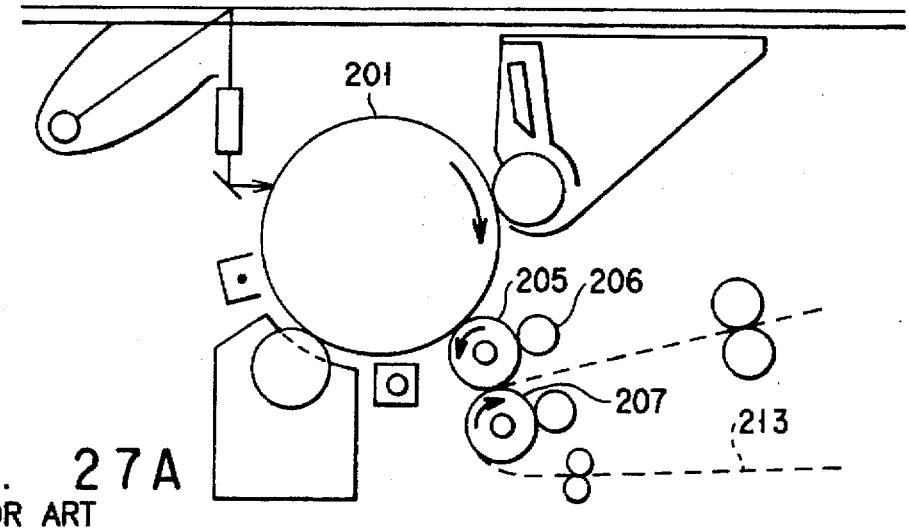
FIG. 27A PRIOR ART
FIG. 27A shows an example of prior art of a cleaning device for an image forming apparatus.
Figure 27B:
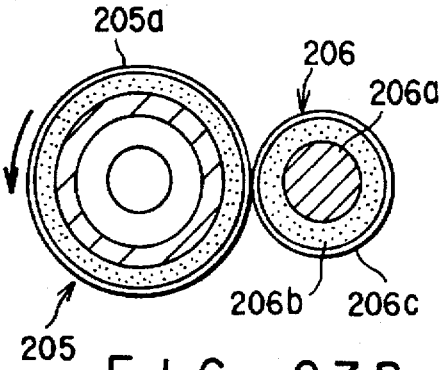
FIG. 27B PRIOR ART
FIG. 27B shows the cleaning device shown in FIG. 27A.
Figure 29A:
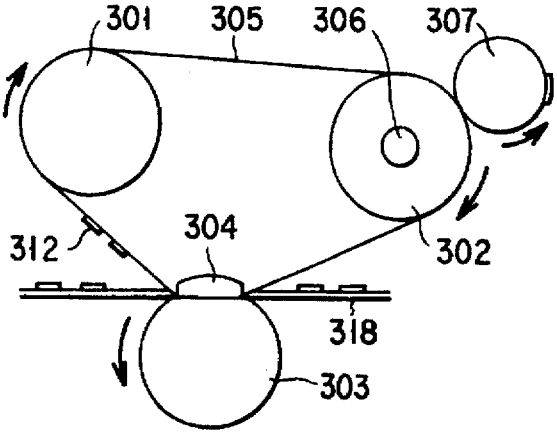
FIG. 29A PRIOR ART
FIG. 29A shows an example of prior art of a cleaning device for a belt fixing device.
Figure 28:
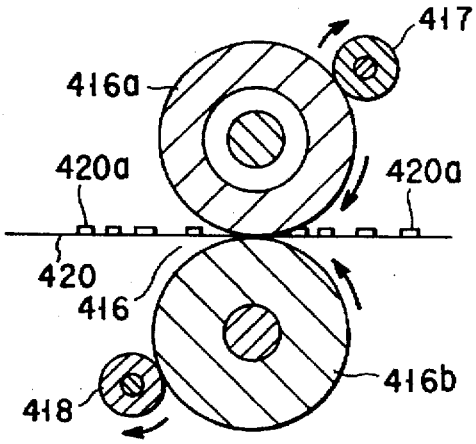
FIG. 28 PRIOR ART
FIG. 28 shows an example of prior art of a cleaning device for a fixing device.
Figure 29B:
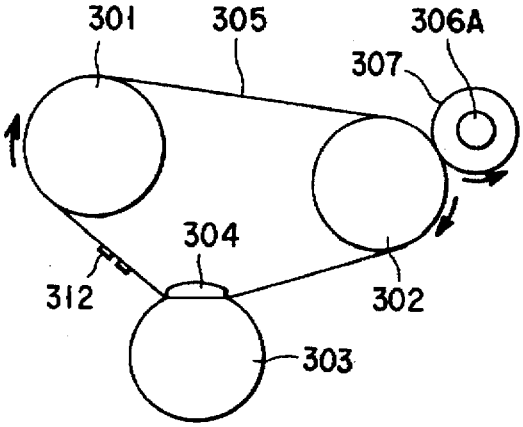
FIG. 29B PRIOR ART
FIG. 29B shows another example of prior art of a cleaning device for a belt fixing device, differing in part from the cleaning device shown in FIG. 29A.
Figure 30:
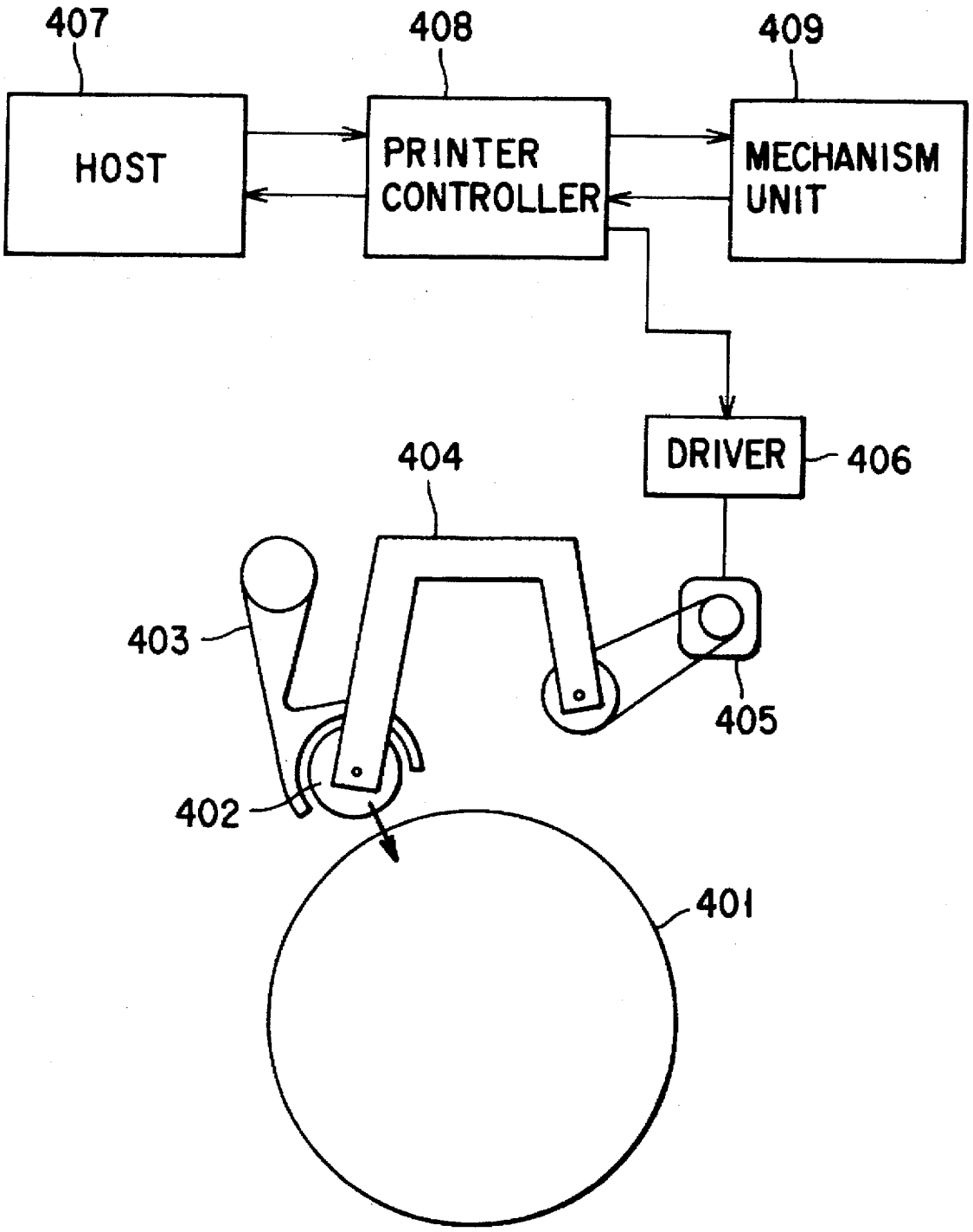
FIG. 30 PRIOR ART
FIG. 30 shows an example of prior art of a cleaning device having a mechanism put in contact with and separated from a recording drum of an image forming apparatus.

In the normal image forming operation, the controller 67 performs the following operations, as illustrated in the flow charts of FIGS. 26A and 26B.

The temperature of the dielectric belt 2 at the cleaning position U is set between the first set temperature and second set temperature (step S61) and the temperature of the cleaning roller 10 is set between the third set temperature and fourth set temperature (step S62). If a jam occurs in the convey system of the transfer medium 7 due to some abnormality during the operation and the controller 67 has detected the jam (step S63), the cleaning roller 10 is separated from the dielectric belt 2 (step S64).

The detection of jam is displayed on the display section of the operation panel (not shown) (step S65)

After the jam process is completed (step S66), the warming-up begins (step S67) and it is determined whether the cleaning roller 10 is separated from the dielectric belt 2 (step S68). If the cleaning roller 10 is not separated ("NO" in step S68), the cleaning roller 10 is separated (step S69).

Subsequently, the surface temperature of the dielectric belt 2 at the cleaning position U is set between the first set temperature and second set temperature (steps S70 and S71) and the temperature of the cleaning roller 10 is set at the third set temperature (steps S70 and S72).

After it is confirmed that the surface temperatures of the dielectric belt 2 and cleaning roller 10 at the cleaning position U of the dielectric belt 2 have been set in the aforementioned ranges, the cleaning roller 10 is put in contact with the dielectric belt 2 and the cleaning operation is started (step S73). Then, it is determined by the sensor 68 whether the printing surface of the dielectric belt 2 is stained (step S74). After it is recognized that the dielectric belt 2 is not stained, the cleaning operation is completed (step S75). Then, the surface temperature of the cleaning roller 10 is set at the fourth set temperature (step S76). Thereafter, the apparatus enters the image formation wait state and, upon receiving the image formation command, starts the image forming operation.

The operation of the present embodiment will now be described.

In a cleaning device wherein toner is thermally softened and removed, a good cleaning effect cannot be obtained unless a temperature distribution proper to toner is obtained at the cleaning position U. The temperature distribution proper to toner has a range, and the cleaning effect is higher at lower temperatures in the range. At the cleaning position U, the surface temperature of the dielectric belt 2 is higher than that of the cleaning roller 10. Thus, as the surface temperature of the cleaning roller 10 is set at a lower value, the difference in temperature increases and also the amount of heat which must be supplied to the dielectric belt 2 increases. Accordingly, the amount of heat which must be absorbed from the cleaning roller 10 increases. As a result, the power consumption increases. In consideration of this, in the normal image formation mode the surface temperature of the cleaning roller 10 is set at a higher value within the range of the temperature distribution proper to toner, thereby saving the power. When the degree of stain on the belt is high, for example, at the time of restart after the Jam process, the surface temperature of the cleaning roller 10 is set at a lower level within the range of the temperature distribution proper to toner, thereby enhancing the cleaning effect.

Accordingly, the present embodiment has the following advantage.

In the normal image formation mode, the surface temperature of the cleaning roller 10 is set at a higher level within the range of the temperature distribution proper to toner, thereby to save power and sufficiently perform the cleaning operation. When the degree of stain on the dielectric belt 2 increases due to various factors after the jam process, etc., the surface temperature of the cleaning roller 10 is set at a lower level within the range of the temperature distribution proper to toner, thereby enhancing the cleaning effect.

Needless to say, various modifications can be made to the structural elements of this embodiment. For example, in this embodiment, the heat roller 8 is used as means for heating the dielectric belt 2 and is also used as driving roller. However, another roller may be used as driving roller, and a ceramic heater, a planar heater, etc. may be used as heating means.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and catch toner remaining on said endless member after the toner image is transferred from said endless member to said recording medium, said endless cleaning member comprising a rotatable cleaning roller having a surface which contacts said endless member and adheres the toner remaining on said endless member after the toner image is transferred from said endless member to said recording medium; and toner removing means for removing the toner adhered to said endless cleaning member, said toner removing means comprising a cleaning roller temperature lowering device for lowering a surface temperature of said cleaning roller and solidifying the toner adhered to the surface of the cleaning roller, and a refresh device for removing the solidified toner from the surface of the cleaning roller;

wherein said cleaning roller temperature lowering device includes a contacting/separating mechanism for contacting/separating said cleaning roller with/from said endless member; and wherein said contacting/separating mechanism comprises:

a spring for separating the cleaning roller from the endless member; and an electromagnetic clutch for pressing the cleaning roller on the endless member when power is supplied to the electromagnetic clutch.

2. The cleaning device according to claim 1 wherein said toner removing means includes:

a stain sensor for sensing a stain on the surface of the cleaning roller; and a controller for controlling said contacting/separating mechanism on the basis of information obtained from said stain sensor; and wherein said stain sensor includes a measuring device for measuring a variation in distance between the stain sensor and the cleaning roller.

3. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and catch toner remaining on said endless member after the toner image is transferred from said endless member to said recording medium, said endless cleaning member comprising a rotatable cleaning roller having a surface which contacts said endless member and adheres the toner remaining on said endless member after the toner image is transferred from said endless member to said recording medium; and toner removing means for removing the toner adhered to said endless cleaning member, said toner removing means comprising a cleaning roller temperature lowering device for lowering a surface temperature of said cleaning roller and solidifying the toner adhered to the surface of the cleaning roller, and a refresh device for removing the solidified toner from the surface of the cleaning roller;

wherein said toner removing means further includes a vibrating device for vibrating the cleaning roller.

4. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and catch toner remaining on said endless member after the toner image is transferred from said endless member to said recording medium, said endless cleaning member comprising a rotatable cleaning roller having a surface which contacts said endless member and adheres the toner remaining on said endless member after the toner image is transferred from said endless member to said recording medium; and toner removing means for removing the toner adhered to said endless cleaning member, said toner removing means comprising a cleaning roller temperature lowering device for lowering a surface temperature of said cleaning roller and solidifying the toner adhered to the surface of the cleaning roller, and a refresh device for removing the solidified toner from the surface of the cleaning roller;

wherein said toner removing means includes a cooling device for forcedly cooling the cleaning roller.

5. The cleaning device according to claim 4, wherein said endless member comprises a transfer belt which bears a toner image and transfers and fixes the toner image onto the recording medium in cooperation with a pressing roller rotated in accordance with a rotation of said transfer belt.

6. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and catch toner remaining on said endless member after the toner image is transferred from said endless member to said recording medium, said endless cleaning member comprising a rotatable cleaning roller having a surface which contacts said endless member and adheres the toner remaining on said endless member after the toner image is transferred from said endless member to said recording medium; and toner removing means for removing the toner adhered to said endless cleaning member, said toner removing means comprising a cleaning roller temperature lowering device for lowering a surface temperature of said cleaning roller and solidifying the toner adhered to the surface of the cleaning roller, and a refresh device for removing the solidified toner from the surface of the cleaning roller;

wherein said refresh device includes:

a brush adapted to contact the surface of the cleaning roller; and a rotating device for rotating the brush so that said refresh device shocks and breaks the toner adhered to the surface of the cleaning roller to thereby facilitate removal of the solidified toner from the surface of the cleaning roller.

7. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and catch toner remaining on said endless member after the toner image is transferred from said endless member to said recording medium, said endless cleaning member comprising a rotatable cleaning roller having a surface which contacts said endless member and adheres the toner remaining on said endless member after the toner image is transferred from said endless member to said recording medium; and toner removing means for removing the toner adhered to said endless cleaning member;

wherein said toner removing means includes:

a contacting/separating mechanism for contacting/separating said cleaning roller with/from said endless member; and a cleaning roller temperature raising device for raising a surface temperature of the cleaning roller when the cleaning roller is separated from the endless member, thereby melting the toner adhered to the surface of the cleaning roller.

8. The cleaning device according to claim 7, wherein said contacting/separating mechanism comprises:

a spring for separating the cleaning roller from the endless member;and an electromagnetic clutch for pressing the cleaning roller on the endless member.

9. The cleaning device according to claim 7, wherein said cleaning roller temperature raising device has a heater for heating the cleaning roller, said heater being provided within said cleaning roller.

10. The cleaning device according to claim 7, wherein said toner removing means further includes:

a stain sensor for sensing a stain on the surface of the cleaning roller; and a controller for controlling said contacting/separating mechanism on the basis of information obtained from said stain sensor.

11. The cleaning device according to claim 10, wherein said stain sensor includes:

a lighting device for radiating light on the cleaning roller; and a measuring device for measuring an amount of reflection light reflected from the cleaning roller.

12. The cleaning device according to claim 10, wherein said stain sensor includes a measuring device for measuring a variation in distance between the stain sensor and the cleaning roller.

13. The cleaning device according to claim 7, further including a driving device for driving the endless member at a speed lower than a normal speed when the image forming apparatus is restarted after an emergency halt.

14. The cleaning device according to claim 7, wherein said toner removing means further includes:

a rotating device for rotating the cleaning roller separated from the endless member; and a refresh device or removing melted toner from the surface of the cleaning roller when the cleaning roller is separated from the endless member.

15. The cleaning device according to claim 14, wherein said refresh device includes a blade member adapted to contact the surface of the cleaning roller.

16. The cleaning device according to claim 15, wherein said refresh device further includes a heater for heating the blade member.

17. The cleaning device according to claim 14, wherein said refresh device includes an absorbing member for absorbing the melted toner, said absorbing member being adapted to contact the surface of the cleaning roller.

18. The cleaning device according to claim 17, wherein said refresh device further includes a heater for heating the absorbing member.

19. The cleaning device according to claim 14, wherein said refresh device includes:

an absorbing member for absorbing the melted toner; and a device for bringing the absorbing member into contact with a lower surface of the cleaning roller when the cleaning roller is separated from the endless member.

20. The cleaning device according to claim 14, wherein said toner removing means includes an inclining device for inclining the cleaning roller when the cleaning roller is separated from the endless member.

21. The cleaning device according to claim 20, wherein said inclining device includes:

a spring for pulling up one end portion of the cleaning roller;

an electromagnetic clutch for pulling down said one end portion of the cleaning roller.

22. The cleaning device according to claim 7, wherein said endless member comprises a transfer belt which bears a toner image and which transfers and fixes the toner image onto the recording medium in cooperation with a pressing roller rotated in accordance with a rotation of said transfer belt.

23. The cleaning device according to claim 7, wherein said endless member comprises a dielectric belt which bears a toner image and which transfers and fixes the toner image onto the recording medium in cooperation with a pressing roller rotated in accordance with a rotation of said dielectric belt.

24. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and catch toner remaining on said endless member after the toner image is transferred from said endless member to said recording medium, said endless cleaning member comprising an endless cleaning belt which is driven by said endless member and which adheres the toner remaining on said endless member after the toner image is transferred from said endless member to said recording medium; and toner removing means for removing the toner adhered to said endless cleaning member, said toner removing means including a blade member adapted to contact said cleaning belt;

wherein said cleaning device further includes a first support roller and a second support roller for supporting the cleaning belt, said first support roller being adapted to indirectly contact the endless member with the cleaning belt interposed therebetween, and said second support roller being separated from the endless member; and wherein said toner removing means includes a cooling device for cooling the second support roller so as to cool and solidify the toner adhered to the cleaning belt.

25. The cleaning device according to claim 24, wherein said cooling device includes a fan motor for feeding outside air into the second support roller.

26. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and catch toner remaining on said endless member after the toner image is transferred from said endless member to said recording medium, said endless cleaning member comprising an endless cleaning belt which is driven by said endless member and which adheres the toner remaining on said endless member after the toner image is transferred from said endless member to said recording medium; and toner removing means for removing the toner adhered to said endless cleaning member, said toner removing means including a blade member adapted to contact said cleaning belt;

wherein said cleaning device further includes a first support roller and a second support roller for supporting the cleaning belt, said first support roller being adapted to indirectly contact the endless member with the cleaning belt interposed therebetween, and said second support roller being separated from the endless member; and wherein said toner removing means includes a heating device for heating the second support roller.

27. The cleaning device according to claim 26, wherein said heating device has a heater within the second support roller.

28. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and adhere toner remaining on said endless member after the toner image is transferred from said endless member to said recording medium; and toner removing means for removing the toner adhered to said endless cleaning member;

wherein said endless cleaning member includes a cleaning roller adapted to be rotated in accordance with a rotation of the endless member, and wherein said toner removing means includes multilayered cleaning films wound around a surface of the cleaning roller, said cleaning films being removable from the surface of the cleaning roller one by one beginning with an outermost one of the cleaning films.

29. The cleaning device according to claim 28, wherein said cleaning films have a surface energy higher than a surface energy of the cleaning roller.

30. The cleaning device according to claim 28, wherein each of said cleaning films has perforations formed between end portions of the cleaning roller.

31. The cleaning device according to claim 30, wherein each of said cleaning films has a tab projecting from one of the end portions of the cleaning roller, said tab being adapted to be pulled to cut away one of the cleaning films along the respective perforations thereof.

32. The cleaning device according to claim 28, wherein said endless member comprises a transfer belt which bears a toner image and transfers and fixes the toner image-onto the recording medium in cooperation with a pressing roller rotated in accordance with a rotation of said transfer belt.

33. The cleaning device according to claim 28, wherein said endless member comprises a dielectric belt which bears a toner image and transfers and fixes the toner image onto the recording medium in cooperation with a pressing roller rotated in accordance with a rotation of said dielectric belt.

34. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and adhere toner remaining on said endless member after the toner image is transferred from said endless member to said recording medium; and toner removing means for removing the toner adhered to said endless cleaning member;

wherein said endless cleaning member includes an endless pressing member driven in accordance with a movement of the endless member, said endless pressing member having a surface energy higher than a surface energy of the endless member, and wherein the recording medium bearing a toner image is supplied to a point between the endless member and the endless pressing member to thereby achieve fixing of the toner image.

35. The cleaning device according to claim 34, wherein:

said endless pressing member includes a rotatable pressing roller having a surface to which the toner adheres, and said toner removing means includes:

a pressing roller temperature lowering device for lowering a surface temperature of the pressing roller so as to solidify the toner adhered to the surface of the pressing roller; and a refresh device for removing the solidified toner from the surface of the pressing roller.

36. The cleaning device according to claim 35, wherein said pressing roller temperature lowering device includes a contacting/separating mechanism for contacting/separating the pressing roller with/from the endless member.

37. The cleaning device according to claim 36, wherein said refresh device includes a blade member adapted to contact the pressing roller when the pressing roller is separated from the endless member.

38. The cleaning device according to claim 36, wherein said toner removing means further includes:

a stain sensor for sensing a stain on the surface of the pressing roller; and a controller for controlling the contacting/separating mechanism on the basis of information obtained from said stain sensor.

39. The cleaning device according to claim 34, wherein:

said endless pressing member includes a rotatable pressing roller, and said toner removing means includes a cleaning member feed device for feeding a sheet-like cleaning member to a point between the endless member and the pressing roller, said sheet-like cleaning member having a length greater than a circumferential length of the pressing roller.

40. The cleaning device according to claim 39, wherein said toner removing means further includes:

a stain sensor for sensing a stain on the surface of the pressing roller; and a controller for controlling the cleaning member feed device on the basis of information obtained from said stain sensor.

41. The cleaning device according to claim 39, wherein said sheet-like cleaning member comprises the recording medium.

42. The cleaning device according to claim 34, wherein:

said endless pressing member includes a pressing belt driven by the endless member, said toner removing means includes a blade member adapted to contact the pressing belt, and said cleaning device further includes a first support roller and a second support roller for supporting the pressing belt, the first support roller being adapted to indirectly contact the endless member with the pressing belt interposed therebetween, and the second support roller being separated from the endless member.

43. The cleaning device according to claim 42, wherein said blade member is adapted to indirectly contact the second support roller with the pressing belt interposed therebetween.

44. The cleaning device according to claim 42, wherein said toner removing means includes a cooling device for cooling the second support roller.

45. The cleaning device according to claim 44, wherein said cooling device includes a fan motor for feeding outside air into the second support roller.

46. The cleaning device according to claim 42, wherein said toner removing means includes a heating device for heating the second support roller.

47. The cleaning device according to claim 46, wherein said heating device includes a heater within the second support roller.

48. The cleaning device according to claim 34, wherein said endless member comprises a transfer belt which bears a toner image and transfers and fixes the toner image onto the recording medium in cooperation with an endless pressing roller rotated in accordance with a rotation of said transfer belt.

49. The cleaning device according to claim 34, wherein said endless member comprises a dielectric belt which bears a toner image and transfers and fixes the toner image onto the recording medium in cooperation with an endless pressing roller rotated in accordance with a rotation of said dielectric belt.

50. A cleaning device adapted to be provided in an image forming apparatus for cleaning an endless member which is put in contact with a recording medium in order to transfer a toner image from said endless member to said recording medium, said cleaning device comprising:

an endless cleaning member adapted to contact said endless member and adhere toner remaining on said endless member after the toner image is transferred from said endless member to said recording medium; and toner removing means for removing the toner adhered to said endless cleaning member;

wherein said endless member comprises a transfer belt which bears a toner image and transfers and fixes the toner image onto the recording medium in cooperation with a pressing roller rotated in accordance with a rotation of said transfer belt; and wherein said image forming apparatus includes a plurality of support rollers for rotatably supporting the transfer belt, at least one of said support rollers having a surface coated with an adhesive member.

51. The cleaning device according to claim 50, wherein said image forming apparatus further includes a cleaning member for cleaning the surface of said at least one of the support rollers having its surface coated with the adhesive member.

52. A cleaning system in an image forming apparatus for cleaning an endless member which comes into contact with a recording medium in order to transfer a toner image from said endless member to said recording medium, said cleaning system comprising:

a first cleaning device;

a second cleaning device; and a controller for controlling the first and second cleaning devices so that one of the first and second cleaning devices is refreshed while the other is being driven, each of the cleaning devices including:

an endless cleaning member adapted to contact said endless member and adhere toner remaining on said endless member after the fixation being adhered to said endless cleaning member; and toner removing means for removing toner which is adhered to the cleaning member.

53. The cleaning system according to claim 52, wherein:

said endless cleaning member comprises a rotatable cleaning roller having a surface to which the toner adheres, and said toner removing means comprises:

a cleaning roller temperature lowering device for lowering a surface temperature of the cleaning roller so as to solidify the toner adhered to the surface of the cleaning roller, and a refresh device for removing the solidified toner from the surface of the cleaning roller.

54. The cleaning system according to claim 53, wherein said cleaning roller temperature lowering device includes a contacting/separating mechanism for contacting/separating said cleaning roller with/from said endless member.

55. The cleaning system according to claim 54, wherein said controller controls contacting/separating mechanism of each of the cleaning devices such that the cleaning roller of at least one of the cleaning devices is constantly put in contact with the endless member.

56. The cleaning system according to claim 54, wherein said controller controls the contacting/separating mechanism of each of the cleaning devices such that the cleaning rollers of both the cleaning devices are constantly put in contact with the endless member when the image forming apparatus is restarted after an emergency halt.

57. The cleaning device according to claim 54, wherein said contacting/separating mechanism comprises:

a spring for separating the cleaning roller from the endless member; and an electromagnetic clutch for pressing the cleaning roller on the endless member.

58. The cleaning system according to claim 54 wherein said toner removing means further includes a stain sensor for sensing a stain on the surface of the cleaning roller, and said controller controls said contacting/separating mechanism on the basis of information obtained from said stain sensor.

59. The cleaning system according to claim 54, wherein said refresh device includes a blade member adapted to contact the surface of the cleaning roller.

60. The cleaning system according to claim 52, wherein said endless member comprises a transfer belt which bears a toner image and transfers and fixes the toner image onto the recording medium in cooperation with a pressing roller rotated in accordance with a rotation of said transfer belt.

61. The cleaning system according to claim 52, wherein said endless member comprises a dielectric belt which bears a toner image and transfers and fixes the toner image onto the recording medium in cooperation with a pressing roller rotated in accordance with a rotation of said dielectric belt.

62. An image forming apparatus comprising:

a movably supported loop-shaped endless belt;

a driving device for driving the endless belt;

means for forming a toner image on the endless belt;

means for transferring and fixing the toner image on the endless belt onto a recording medium;

a cleaning device for removing a residual toner on the endless belt after the transfer and fixation, said cleaning device having a cleaning roller adapted to contact the endless belt at a cleaning position and be rotated in accordance with the movement of the endless belt; and temperature control means for controlling surface temperatures of the endless belt and the cleaning roller near said cleaning position.

63. The image forming apparatus according to claim 62, wherein said temperature control means includes:

means for controlling the surface temperature of the endless belt such that a viscosity of the toner on the endless belt is $2\times10^2$ or above, and means for controlling the surface temperature of the cleaning roller such that the viscosity of the toner on the cleaning roller is $5\times10^4$ or less.

64. The image forming apparatus according to claim 62, wherein said temperature control means includes:

belt temperature control means for controlling the surface temperature of the endless belt; and cleaner temperature control means for controlling the surface temperature of the cleaning roller.

65. The image forming apparatus according to claim 64, wherein said belt temperature control means comprises:

a heat roller adapted to indirectly contact the cleaning roller with the endless belt interposed therebetween, said heat roller having a heater within the heat roller;

a temperature sensor for sensing the surface temperature of the endless belt near the cleaning position; and a controller for controlling the turning-on/off of the heater on the basis of information obtained from the temperature sensor so as to maintain the surface temperature of the endless belt at a desired value.

66. The image forming apparatus according to claim 64, wherein said cleaner temperature control means comprises:

cooling means for cooling the cleaning roller;

heating means for heating the cleaning roller;

a temperature sensor for sensing the surface temperature of the cleaning roller; and a cleaner temperature control circuit for controlling the turning-on/off of the cooling means and the heating means on the basis of information obtained from said temperature sensor so as to maintain the surface temperature of the cleaning, roller at a desired value.

67. The image forming apparatus according to claim 66, wherein:

said cleaning roller has a hollow cylindrical shape with an internal space, said heating means includes a halogen lamp disposed within the internal space of the cleaning roller and extending in an axial direction of the cleaning roller, and said cooling means includes a suction cooling device for sucking air from the internal space of the cleaning roller.

68. The image forming apparatus according to claim 62, wherein said endless belt comprises a dielectric belt.

69. The image forming apparatus according to claim 62, wherein said cleaning device includes a contacting/separating mechanism for contacting/separating the cleaning roller with/from the endless belt, said image forming apparatus includes a controller for controlling said contacting/separating mechanism and said temperature control means, and said temperature control means includes:

belt temperature control means for controlling the surface temperature of the endless belt; and cleaner temperature control means for controlling the surface temperature of the cleaning roller.

70. The image forming apparatus according to claim 69, wherein said controller includes means for controlling the contacting/separating mechanism so as to separate the cleaning roller from the endless belt in one of the following two cases:

a) when the surface temperature of the endless belt falls outside a temperature range between a first set temperature and a second set temperature, and b) when the surface temperature of the cleaning roller falls outside a temperature range between a third set temperature and a fourth set temperature.

71. The image forming apparatus according to claim 70, wherein the first set temperature is a lowest temperature in a temperature range of the endless belt within which good cleaning can be performed, the second set temperature is a highest temperature in the temperature range of the endless belt within which good cleaning can be performed, the third set temperature is a lowest temperature in a temperature range of the cleaning roller within which good cleaning can be performed, and the fourth set temperature is a highest temperature in the temperature range of the cleaning roller within which good cleaning can be performed.

72. The image forming apparatus according to claim 69, wherein said controller includes:

means for recognizing an on/off state of a power supply of the apparatus, means for controlling the contacting/separating mechanism such that the cleaning roller is separated from the endless belt immediately after said power supply is turned on, means for controlling the belt temperature control means such that the surface temperature of the endless belt falls within a range between a first set temperature and a second set temperature, means for controlling the cleaner temperature control means such that the surface temperature of the cleaning roller falls within a range between a third set temperature and a fourth set temperature, and means for controlling the contacting/separating mechanism so as to bring the cleaning roller into contact with the endless belt after confirming that the surface temperature of the endless belt is in the range between the the third set temperature and the fourth set temperature.

73. The image forming apparatus according to claim 72, wherein the first set temperature is a lowest temperature in a temperature range of the endless belt within which good cleaning can be performed, the second set temperature is a highest temperature in the temperature range of the endless belt within which good cleaning can be performed, the third set temperature is a lowest temperature in a temperature range of the cleaning roller within which good cleaning can be performed, and the fourth set temperature is a highest temperature in the temperature range of the cleaning roller within which good cleaning can be performed.

74. The image forming apparatus according to claim 69, wherein said controller includes:

set time input means for inputting a predetermined set time;

counting means for counting time; and set time comparing means for comparing the time counted by said counting means with the set time, and wherein said counting means begins to count time after the formation of the toner image on the recording medium is completed, and wherein if the time counted by said counting means exceeds the set time with no subsequent image formation operation having taken place, the controller enters a wait state and controls the contacting/separating mechanism to separate the cleaning roller from the endless belt.

75. The image forming apparatus according to claim 74, wherein when a subsequent image formation operation takes place when said controller is in the wait state, said controller controls the belt temperature control means such that the surface temperature of the endless belt falls within a range between a first set temperature and a second set temperature, said controller controls the cleaner temperature control means such that the surface temperature of the cleaning roller falls within a range between a third set temperature and a fourth set temperature, and said controller controls the contacting/separating mechanism so as to bring the cleaning roller into contact with the endless belt after confirming that the surface temperature of the endless belt is in the range between the first set temperature and the second set temperature and the surface temperature of the cleaning roller is in the range between the third set temperature and the fourth set temperature.

76. The image forming apparatus according to claim 75, wherein the first set temperature is a lowest temperature in a temperature range of the endless belt within which good cleaning can be performed, the second set temperature is a highest temperature in the temperature range of the endless belt within which good cleaning can be performed, the third set temperature is a lowest temperature in a temperature range of the cleaning roller within which good cleaning can be performed, and the fourth set temperature is a highest temperature in the temperature range of the cleaning roller within which good cleaning can be performed.

77. The image forming apparatus according to claim 74, wherein said controller includes means for controlling the cleaner temperature control means in the wait state such that the temperature of the cleaning roller is set at a predetermined set temperature.

78. The image forming apparatus according to claim 77, wherein a first set temperature is a lowest temperature in a temperature range of the endless belt within which good cleaning can be performed, a second set temperature is a highest temperature in the temperature range of the endless belt within which good cleaning can be performed, a third set temperature is a lowest temperature in a temperature range of the cleaning roller within which good cleaning can be performed, a fourth set temperature is a highest temperature in the temperature range of the cleaning roller within which good cleaning can be performed, and the predetermined set temperature is between the third set temperature and a normal temperature.

79. The image forming apparatus according to claim 69, wherein said controller includes:

jam detection means for detecting a jam in a conveying system of the recording medium, and means for controlling the contacting/separating mechanism so as to separate the cleaning roller from the endless belt when the jam detection means detects a jam of the recording medium in the conveying system.

80. The image forming apparatus according to claim 79, wherein said controller enters a warming-up state after a jam clearing process is completed, and wherein said controller includes:

means for controlling the belt temperature control means such that the surface temperature of the endless belt falls within a range between a first set temperature and a second set temperature, means for controlling the cleaner temperature control means such that the surface temperature of the cleaning roller falls within a range between a third set temperature and a fourth set temperature, and means for controlling the contacting/separating mechanism so as to bring the cleaning roller into contact with the endless belt after confirming that the surface temperature of the endless belt is in the range between the first set temperature and the second set temperature and the surface temperature of the cleaning roller is in the range between the third set temperature and the fourth set temperature.

81. The image forming apparatus according to claim 80, wherein the first set temperature is a lowest temperature in a temperature range of the endless belt within which good cleaning can be performed, the second set temperature is a highest temperature in the temperature range of the endless belt within which good cleaning can be performed, the third set temperature is a lowest temperature in a temperature range of the cleaning roller within which good cleaning can be performed, and the fourth set temperature is a highest temperature in the temperature range of the cleaning roller within which good cleaning can be performed.

82. The image forming apparatus according to claim 79, wherein said controller further includes a stain sensor for sensing a stain on the endless belt and a detector for detecting removal of the stain on the endless belt, wherein said controller enters a warming-up state after a jam clearing process is completed, and wherein said controller includes:

means for controlling the belt temperature control means such that the surface temperature of the endless belt falls within a range between a first set temperature and a second set temperature, means for controlling the cleaner temperature control means such that the surface temperature of the cleaning roller is set at a third set temperature, and means for controlling the contacting/separating mechanism so as to bring the cleaning roller into contact with the endless belt after confirming that the surface temperature of the endless belt is in the range between the first set temperature and the second set temperature and that the surface temperature of the cleaning roller is the third set temperature, means for initiating a cleaning operation of the endless belt, and means for controlling the cleaner temperature control means such that the surface temperature of the cleaning roller is set at the third set temperature when the detector has detected removal of the stain on the endless belt.

83. The image forming apparatus according to claim 82, wherein the first set temperature is a lowest temperature in a temperature range of the endless belt within which good cleaning can be performed, the second set temperature is a highest temperature in the temperature range of the endless belt within which good cleaning can be performed, the third set temperature is a lowest temperature in a temperature range of the cleaning roller within which good cleaning car be performed, and a fourth set temperature is a highest temperature in the temperature range of the cleaning roller within which good cleaning can be performed.

84. The image forming apparatus according to claim 62, wherein said toner image forming means includes:

means for forming an electrostatic image on the endless belt; and means for developing the electrostatic image formed on the belt using toner, thereby forming the toner image on the endless belt.

85. The image forming apparatus according to claim 62, wherein said toner image forming means includes:

an image carrying body adapted to contact and be driven by the endless belt;

means for forming an electrostatic image on the image carrying body; and means for developing the electrostatic image formed on the image carrying body using toner, thereby forming the toner image on the image carrying body, said toner image then being transferred from the image carrying body onto the endless belt to thereby from the toner image on the endless belt.

* * * * *